US011133127B2

(12) United States Patent
Zhou et al.

(10) Patent No.: US 11,133,127 B2
(45) Date of Patent: Sep. 28, 2021

(54) AUTOMATIC TOROIDAL CORE WINDING MACHINE

(71) Applicant: ZHONGSHAN COMPETENT AUTOMATION EQUIPMENT CO., LTD., Zhongshan (CN)

(72) Inventors: Ke Zhou, Zhongshan (CN); Hui Chen, Zhongshan (CN); Shuyan Liao, Zhongshan (CN); Xiyan Ma, Zhongshan (CN); Qihan Huang, Zhongshan (CN); Peng Liu, Zhongshan (CN); Gang Xiong, Zhongshan (CN)

(73) Assignee: ZHONGSHAN COMPETENT AUTOMATION EQUIPMENT CO., LTD., Zhongshan (CN)

( * ) Notice: Subject to any disclaimer, the term of this patent is extended or adjusted under 35 U.S.C. 154(b) by 602 days.

(21) Appl. No.: 15/774,261

(22) PCT Filed: Jul. 4, 2017

(86) PCT No.: PCT/CN2017/091662
§ 371 (c)(1),
(2) Date: May 7, 2018

(87) PCT Pub. No.: WO2018/099078
PCT Pub. Date: Jun. 7, 2018

(65) Prior Publication Data

US 2019/0115138 A1 Apr. 18, 2019

(30) Foreign Application Priority Data

Dec. 1, 2016 (CN) ..... 201611093449.2
Apr. 24, 2017 (CN) ..... 201720436170.3

(51) Int. Cl.
*H01F 17/06* (2006.01)
*H01F 41/082* (2016.01)
(Continued)

(52) U.S. Cl.
CPC ..... *H01F 17/062* (2013.01); *H01F 27/306* (2013.01); *H01F 41/06* (2013.01);
(Continued)

(58) Field of Classification Search
CPC .... H01F 17/062; H01F 41/082; H01F 41/096; H01F 41/06; H01F 41/08; H01F 27/306
See application file for complete search history.

(56) References Cited

U.S. PATENT DOCUMENTS 3,643,881 A * 2/1972 Beumer ..... H01F 41/08 242/434.7
3,844,495 A * 10/1974 Gorman ..... H01F 41/08 242/434.2
(Continued)

FOREIGN PATENT DOCUMENTS

CN 2475121 Y 1/2002
CN 202093982 U 12/2011
(Continued)

OTHER PUBLICATIONS

Feb. 14, 2018 Office Action issued in Chinese Patent Application No. 201611093449.2.
(Continued)

*Primary Examiner* — Minh N Trinh
(74) *Attorney, Agent, or Firm* — Oliff PLC

(57) ABSTRACT

An automatic toroidal core winding machine, including: a frame, control device, clamping and wire arranging mechanism, winding mechanism, wire delivering mechanism, feeding mechanism, automatic stripping mechanism and wire reclaiming device for reclaiming excessive wires around the shuttle, the winding mechanism including a shuttle and driving device for supporting and driving the shuttle to rotate, the shuttle includes a slider and wire storage and hooking aperture, and the frame includes a detecting and
(Continued)

positioning mechanism used for positioning the ring opening, the slider and the wire storage and hooking aperture of the shuttle, and a wire hanging device for hanging the wire allowing the shuttle to store and wind the wire. The machine achieves automation from wire delivery, feeding, shuttle opening to wire hanging, wire winding, wire cutting, product taking and wire reclaiming with significantly improved production efficiency, reduced restriction and effect on the quality of winding from manual proficiency.

20 Claims, 20 Drawing Sheets

(51) Int. Cl.
*H01F 41/096* (2016.01)
*H01F 41/06* (2016.01)
*H01F 27/30* (2006.01)
*H01F 41/08* (2006.01)

(52) U.S. Cl.
CPC ..... *H01F 41/082* (2016.01); *H01F 41/096* (2016.01); *H01F 41/08* (2013.01)

(56) References Cited

U.S. PATENT DOCUMENTS 4,665,952 A * 5/1987 Macemon ..... H01F 41/08 140/92.2
4,688,733 A * 8/1987 Ishida ..... B65H 51/205 242/434.8
5,875,988 A * 3/1999 Hashimoto ..... H01F 41/08 242/434.8
2003/0038204 A1* 2/2003 Nakazawa ..... H01F 41/08 242/434.4
2005/0082932 A1* 4/2005 Sweeney ..... H02K 15/08 310/179
2007/0062027 A1 3/2007 Ripamonti et al.

FOREIGN PATENT DOCUMENTS

| | | | |
|---|---|---|---|
| CN | 202145424 | U | 2/2012 |
| CN | 202210468 | U | 5/2012 |
| CN | 202871568 | U | 4/2013 |
| CN | 104916425 | A | 9/2015 |
| CN | 106783151 | A | 5/2017 |
| CN | 206340439 | U | 7/2017 |
| JP | H11-136065 | A | 5/1999 |

OTHER PUBLICATIONS

Sep. 27, 2017 International Search Report issued in International Patent Application No. PCT/CN2017/091662.
Sep. 27, 2017 Written Opinion of the International Searching Authority issued in International Patent Application No. PCT/CN2017/091662.
Apr. 30, 2020 Office Action issued in German Patent Application No. 11 2017 000 159.5.

* cited by examiner

AUTOMATIC TOROIDAL CORE WINDING MACHINE

FIELD OF THE INVENTION

The present invention relates to an automatic toroidal core winding machine, belongs to the technical field of winding equipment for toroidal coil.

BACKGROUND OF THE INVENTION

Electromagnetic assembly is widely applied to various fields, and the electromagnetic assemblies are inevitably often used in different types of electronic products, therefore, their production quality is closely related to the service life and quality of the electronic products. Toroidal inductance coils are more extensively used in electromagnetic assemblies, and the existing winding machine on the market generally comprises a wire releaser, a wire delivering assembly, a winding assembly, a feeder and a hopper. A wire is delivered to the winding assembly from the wire releaser, and a toroidal core is placed into the hopper capable of vibrating and fed to a winding working position by the feeder, then, two pairs of inclined wheel sets and winding needles of the winding assembly guide a wire to move circularly within a circular ring so as to wind the wire around the toroidal core turn by turn. A machine with such a structure is high in working speed and is not complex in structure. However, it can only be used for a toroidal core having a great inner diameter, and only one type of wire can be winded around the toroidal core, which limits the machining range of the machine to a large extent. A kind of small toroidal core has a small size, and generally, manual operation is adopted to operate, that is, firstly, an electromagnetic wire is cut into segments, then, the toroidal core is fixed by hand or a tool and the electromagnetic wire segments are winded around the toroidal core manually, thereby forming one or more windings/toroidal coils, finally, production of a small magnetic ring inductor/a toroidal coil or an electronic transformer is completed by finishing, tin coating and the like. Such a toroidal core winding method is extremely low in efficiency and high in labor cost.

SUMMARY OF THE INVENTION

An objective of the present invention is to overcome the defects in the prior art and provide an automatic toroidal core winding machine significantly improved in automation degree with better universality.

The present invention is implemented with the following technical solution:

An automatic toroidal core winding machine, comprising:

a frame configured for installing of various mechanisms thereon;

a control device disposed on the frame and configured to control operation of each mechanism/device;

a clamping and wire arranging mechanism disposed on the frame and configured to clamp and rotate a toroidal core to be winded with a wire;

a winding mechanism comprising a shuttle (also known as wire storage ring) having a ring opening and a driving device for supporting and driving the shuttle to rotate, the shuttle is provided with a slider and a wire storage and hooking aperture, and the frame is provided with a wire hanging device for hanging the wire allowing the shuttle to store the wire and to wind the wire respectively;

a detecting and positioning mechanism disposed around the shuttle and used for positioning the ring opening, the slider and the wire storage and hooking aperture of the shuttle;

a wire delivering mechanism disposed at one side of the frame and configured to deliver a wire to the shuttle, a wire cutting device which connected to the wire hanging device is equipped with the free end of the wire;

a feeding mechanism comprising a vibratory feeder bowl disposed on the frame, a feeding chute docking with the vibratory feeder bowl, and a toroidal core delivering manipulator for clamping and delivering a toroidal core to the clamping and wire arranging mechanism; and an automatic stripping mechanism disposed on the frame and configured to take a winded toroidal core.

In the automatic toroidal core winding machine, the clamping and wire arranging mechanism includes a support, two rubber wheel holders capable of sliding separately and disposed oppositely on the support, the opposite ends of the two rubber wheel holders are respectively provide with a clamping rubber wheel pair, the other ends of the two rubber wheel holders are elastically connected to a jacking cylinder and the support respectively, and a driving assembly for driving the clamping rubber wheel pairs to rotate is disposed on the support.

In the automatic toroidal core winding machine, the driving device includes a driving guide wheel set and two driven guide wheels which all arranged on the frame, the driving guide wheel set is driven by a driving motor to rotate, each of the driven guide wheels is connected with an open-loop assembly capable of driving the driven guide wheel to move to enable the shuttle to be opened and closed in parallel along the ring opening.

In the automatic toroidal core winding machine, the open-loop assembly includes a base disposed on the frame, a sliding rail is disposed on the base, and a power slider is disposed on the sliding rail, which is capable of sliding back and forth thereon, an open-loop driver for driving the power slider to slide is disposed on the base, and the power slider is provided with a supporting part extending into the shuttle and supporting the driven guide wheel.

In the automatic toroidal core winding machine, the wire hanging device includes a pushing assembly capable of clamping a wire and pushing it to the wire storage and hooking aperture, and a fixing bracket, both are arranged on the frame, the fixing bracket is provided with a wire lifting cylinder capable of driving the wire cutting device to move in an axial direction of the shuttle to enable the wire to cling to the edge of the shuttle or the edge of the slider, a wire hooking cylinder capable of driving the wire cutting device to move in a direction perpendicular to the axial direction of the shuttle, and a wire tensioning cylinder for tensioning the wire when the toroidal core is in the process of winding are arranged on the fixing bracket, the pushing assembly includes a pushing cylinder arranged on the frame and a wire clamping manipulator connected to the telescopic end of the pushing cylinder.

In the automatic toroidal core winding machine, the detecting and positioning mechanism includes a shuttle positioning assembly and a slider positioning assembly, the shuttle positioning assembly includes a color spot disposed on the shuttle, a reflective optical fiber for sensing the color spot and transmitting a signal to control the shuttle to stop rotating is disposed on the frame, the slider positioning assembly includes a proximity sensor for sensing the slider, and a wire hanging positioner and a open-loop positioner both for blocking the slider from rotating along with the shuttle.

In the automatic toroidal core winding machine, the slider is integrally-moulded by plastic, and a metal sheet is arranged on the slider as target being sensed.

In the automatic toroidal core winding machine, a notch is formed increasingly deep in the shuttle from the outer periphery to the inner periphery, the tail of the notch is right-angled, and an elastic steel part whose tail against the tail of the notch is welded at the notch, the wire storage and hooking aperture is an included angle formed by the elastic steel part and the notch that gradually decreases to 0 degree from the outer periphery of the shuttle inwardly.

In the automatic toroidal core winding machine, the wire delivering mechanism includes a pedestal, a rubber wheel driven by a motor to rotate is disposed on the pedestal, a detachable wire-in nozzle and a detachable wire-out nozzle run through the pedestal, and the pedestal is provided with a wire hold-down assembly capable of extending out and matching the rubber wheel to deliver a wire, especially a copper wire.

In the automatic toroidal core winding machine, at least two sidewalls of the feeding chute can be installed adjustably in position to allow changing of the inner diameter of the feeding chute.

In the automatic toroidal core winding machine, a wire reclaiming device for reclaiming excessive wires on the shuttle may also be disposed on the frame, the wire reclaiming device includes a pushing-pulling mechanism disposed on a platen of the frame which is capable of sliding away from or close to the shuttle, a wire hooking rod capable of moving perpendicularly to the shuttle is disposed at the end, close to the shuttle, of the pushing-pulling mechanism, and a pair of pneumatic scissors is disposed between the wire hooking rod and the toroidal core on the shuttle, the open end of the pneumatic scissors is higher than the surface of the shuttle.

In the automatic toroidal core winding machine, the wire hooking rod is driven by a telescoping cylinder disposed on the pushing-pulling mechanism to descend into or ascend away from the shuttle.

In the automatic toroidal core winding machine, a connecting plate is disposed on the movable part of the pushing-pulling mechanism, and a fixed block is disposed on the connecting plate, the telescoping cylinder and the pneumatic scissors are disposed at two sides of the fixed block, respectively.

In the automatic toroidal core winding machine, a wire hold-down rod is disposed on the fixed block, the wire hooking rod sleeves the wire hold-down rod, a wire hooking plate opposite to the end of the wire hold-down rod is disposed at the free end of the wire hooking rod.

In the automatic toroidal core winding machine, when hooking a wire, the wire hooking rod is located within the peripheral inner space of the shuttle and faces the toroidal coil on the shuttle. In the automatic toroidal core winding machine, the pushing-pulling mechanism is a twin-rod cylinder.

In the automatic toroidal core winding machine, the wire hooking rod and the wire hooking plate are integrally formed.

Compared with the prior art, the present invention has the following advantages:

The present invention achieves automation from wire delivery, feeding, shuttle (namely as a wire storage ring) opening to wire hanging, wire winding, wire cutting and product taking with significantly improved production efficiency, reduced restriction and effect on the quality of winding both from manual proficiency.

According to the present invention, when the excessive waste wire needs to be reclaimed after completing the winding of a toroidal core, the wire can be reclaimed without forcibly opening the shuttle. The excessive wire is winded around the toroidal core and the wire hooking rod into a ring form, and then the wire is cut by the pneumatic scissors to open the ring, the excessive wire can be reclaimed after the wire is cut at the end of the toroidal core. Automatic operation of collecting waste wire on the shuttle is achieved according to the present invention with high efficiency and high speed. Thus, the service life of the shuttle is improved and the current situation of the existing machine being operated annually is changed.

DETAILED DESCRIPTION

Figure 1:
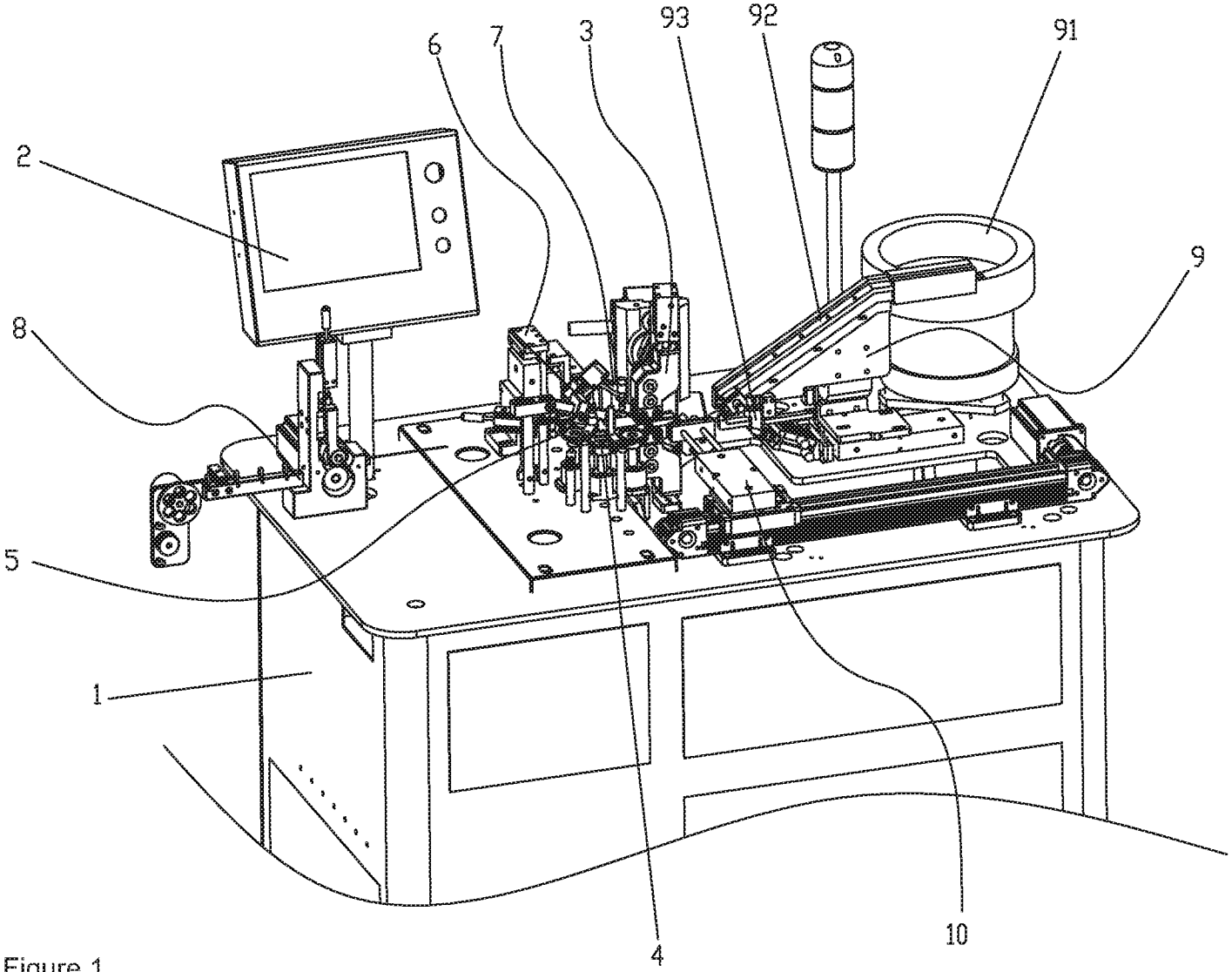
FIG. 1 is a perspective view of an embodiment of the invention.
Figure 2:
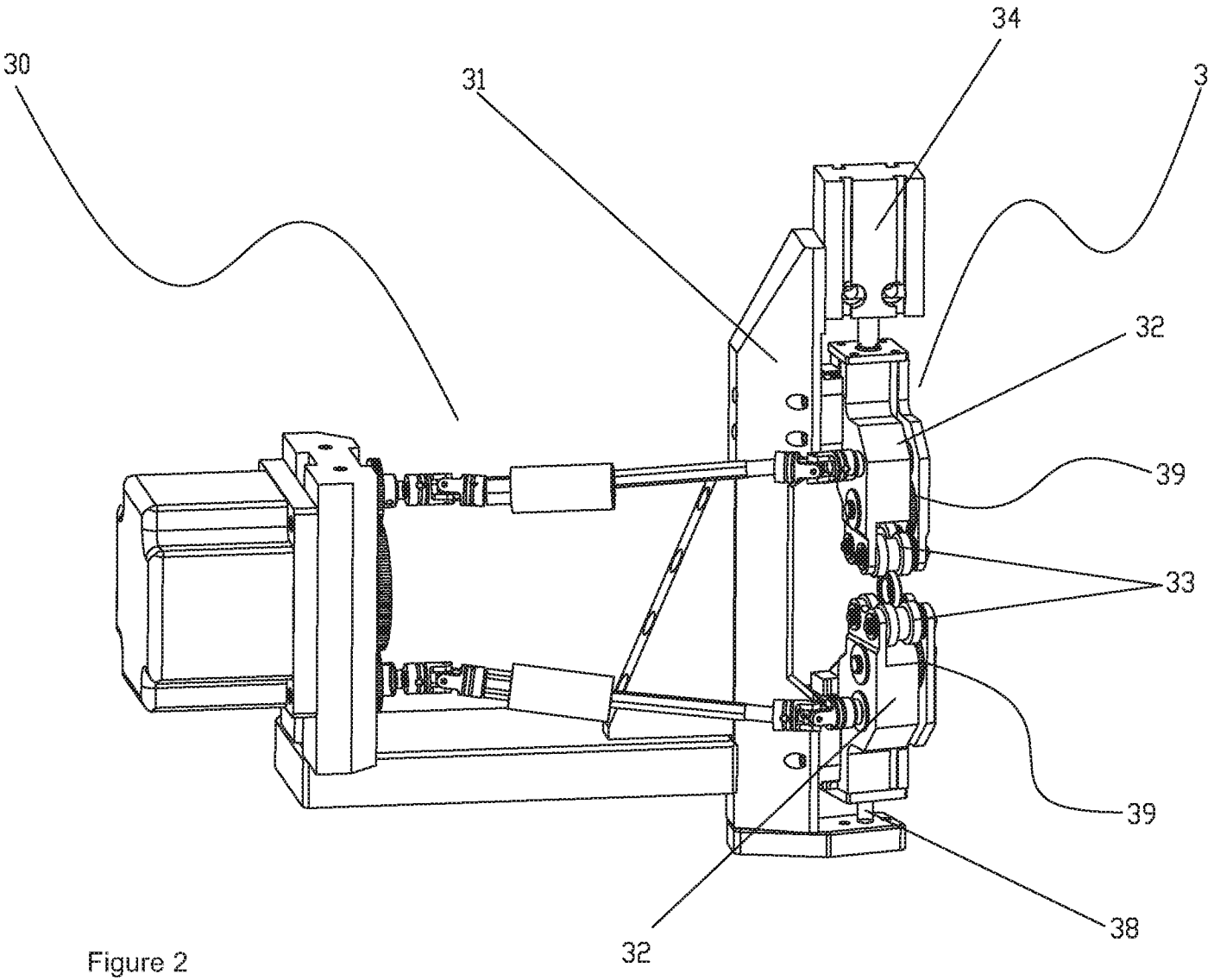
FIG. 2 is a perspective view of the clamping and wire arranging mechanism of the invention.
Figure 3:
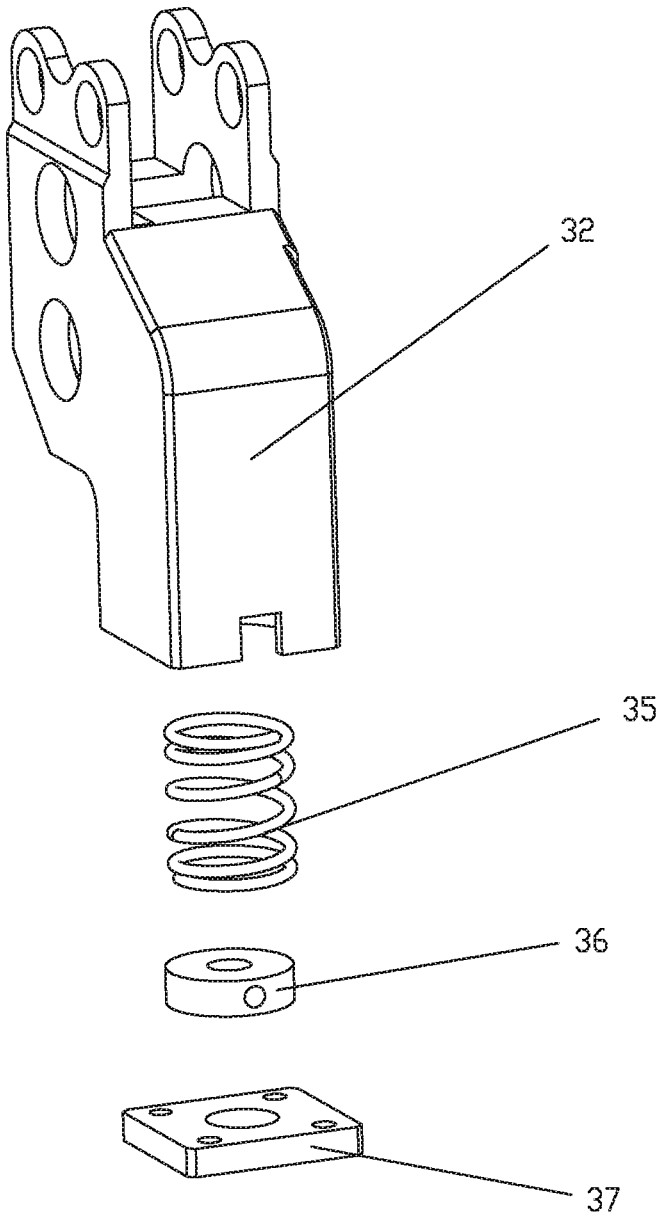
FIG. 3 is an exploded view of the rubber wheel holder of the invention.
Figure 4:
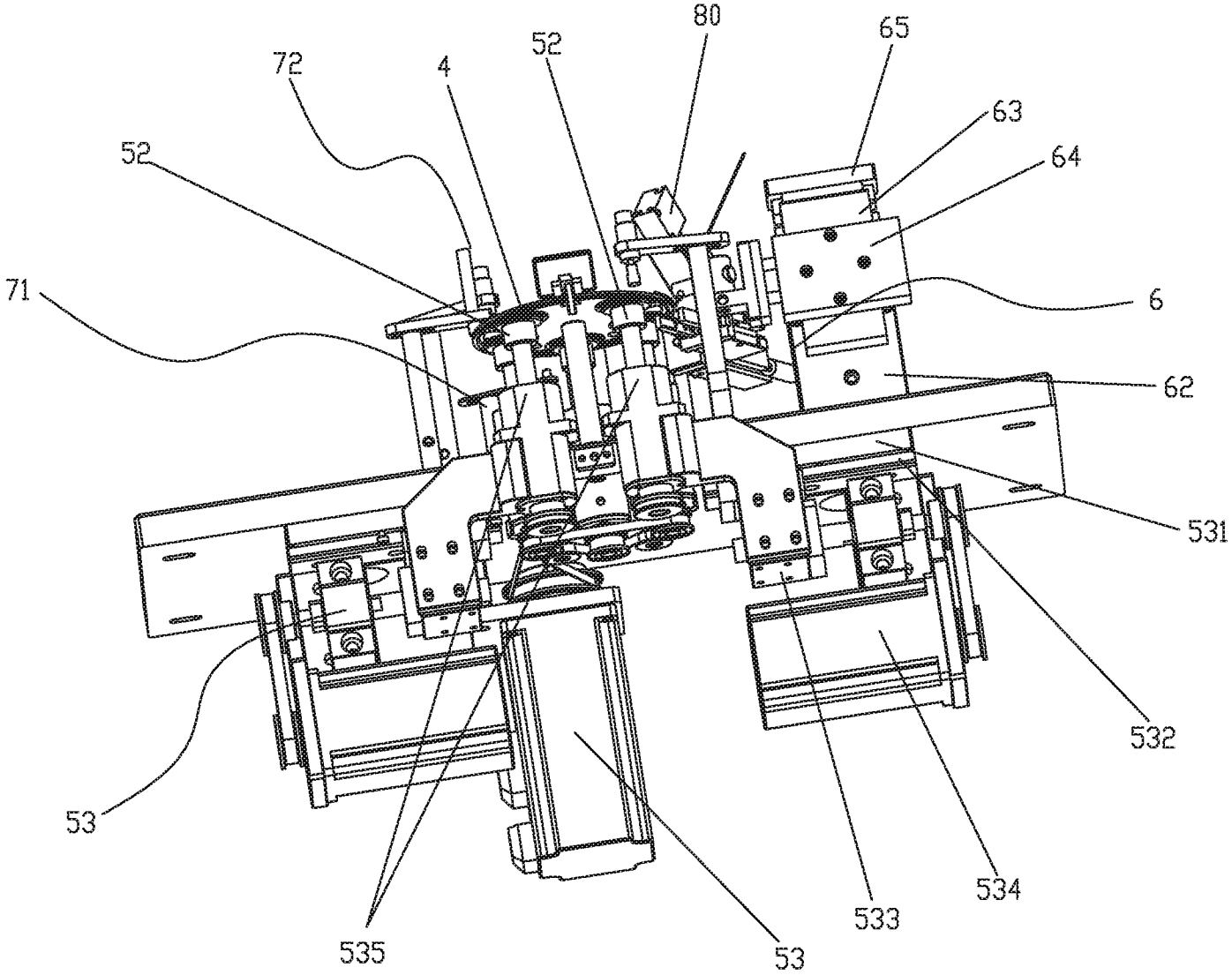
FIG. 4 is one partial view of the invention.
Figure 5:
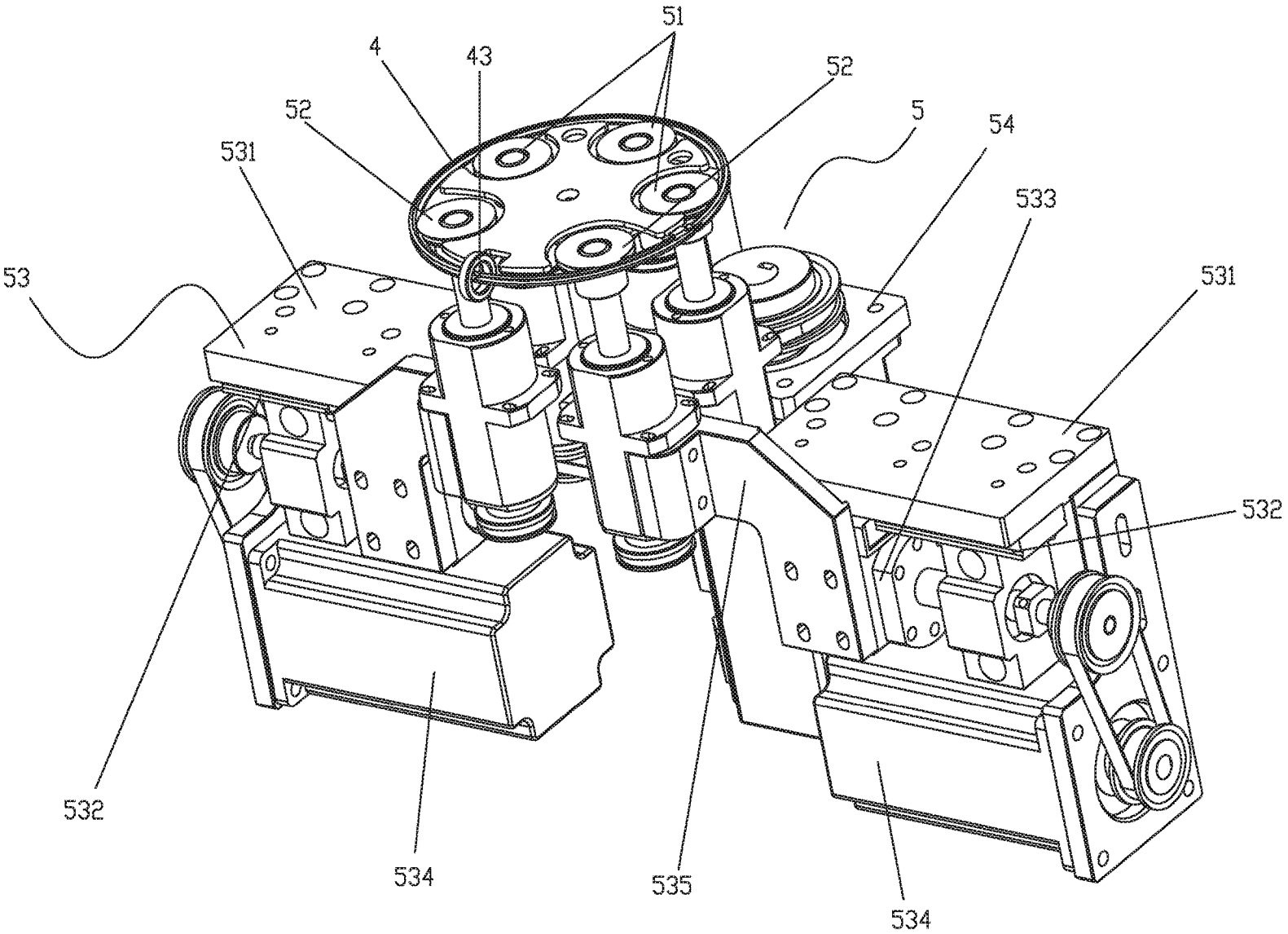
FIG. 5 is another partial view of the present invention.
Figure 6:
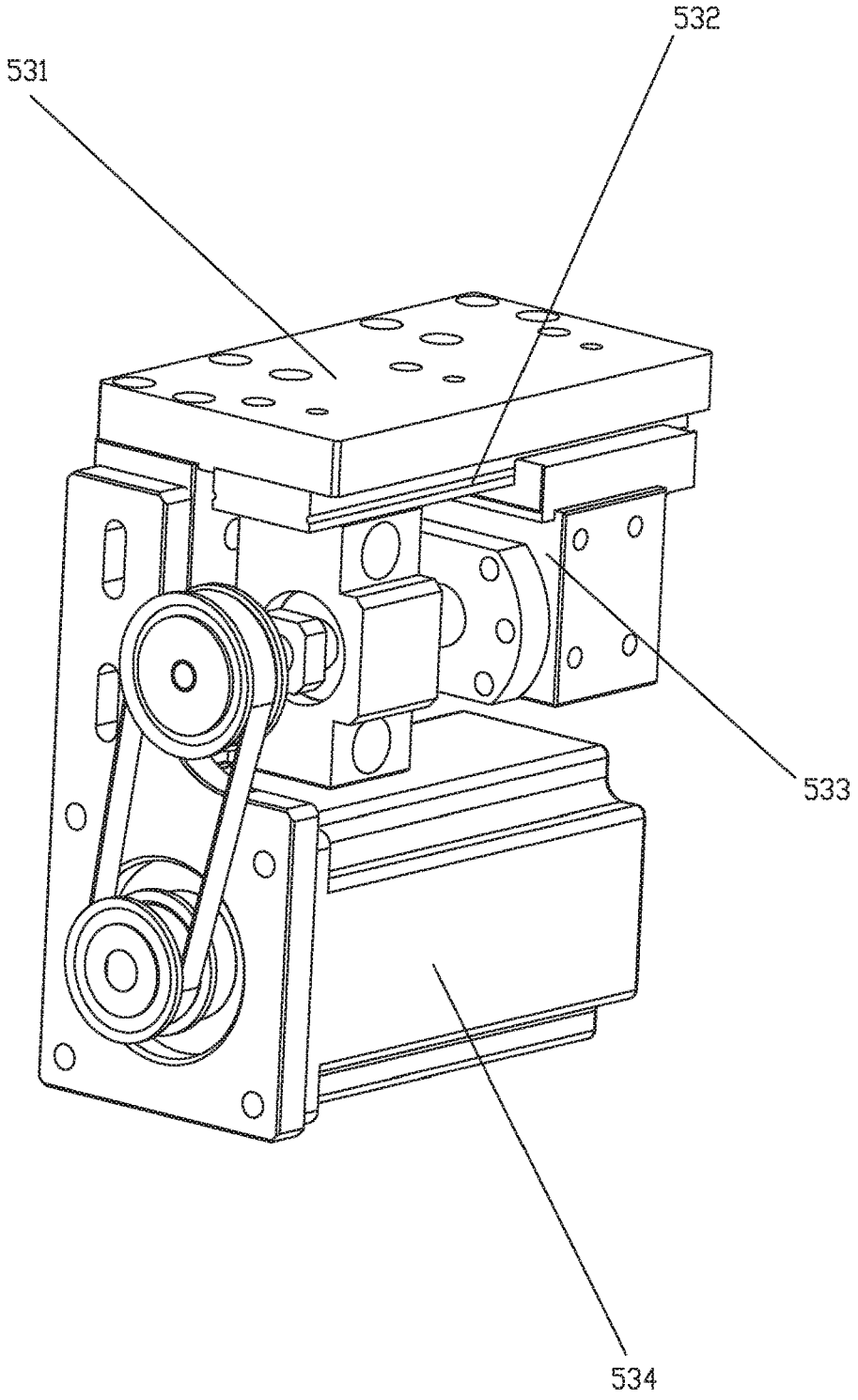
FIG. 6 is a perspective view of the open-loop assembly of the invention.
Figure 7:
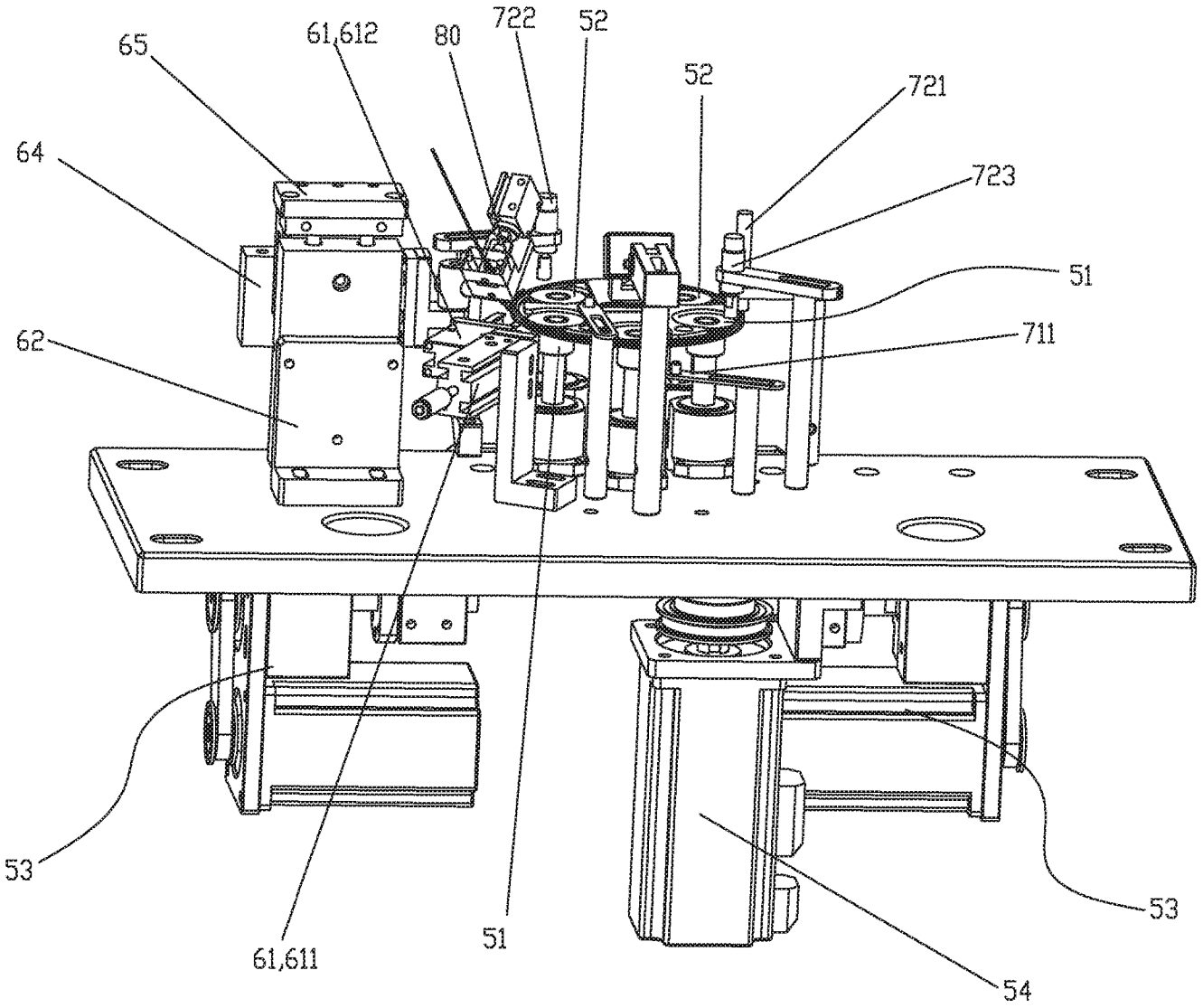
FIG. 7 is the third partial view of the invention.
Figure 8:
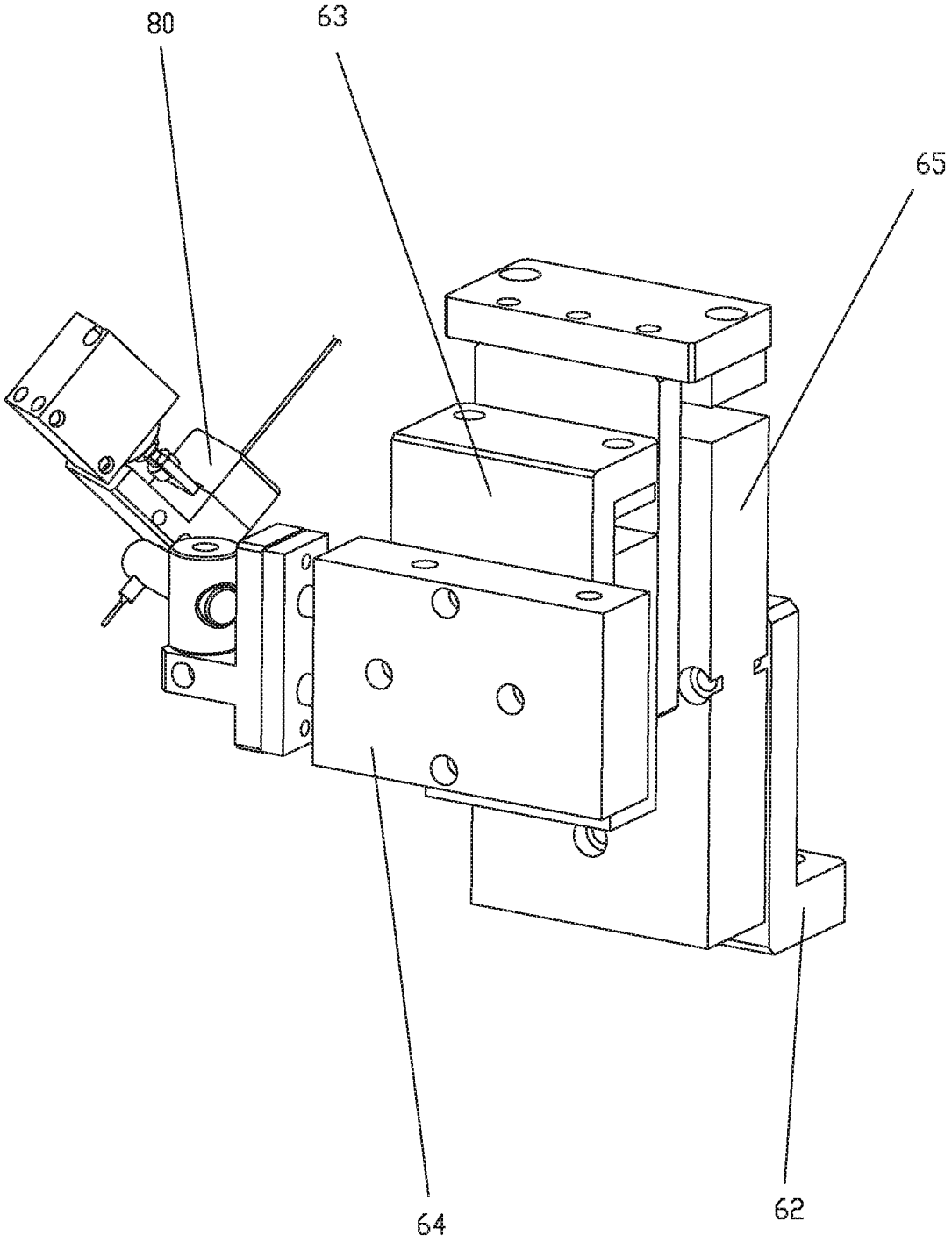
FIG. 8 is a perspective view of the wire hanging device of the invention.
Figure 9:
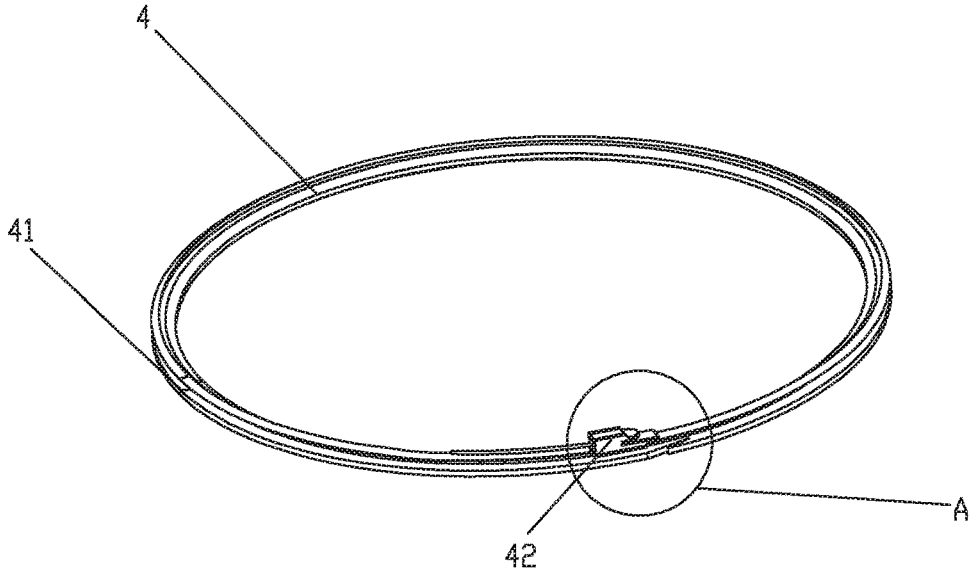
FIG. 9 is a perspective view of the shuttle of the invention.
Figure 10:
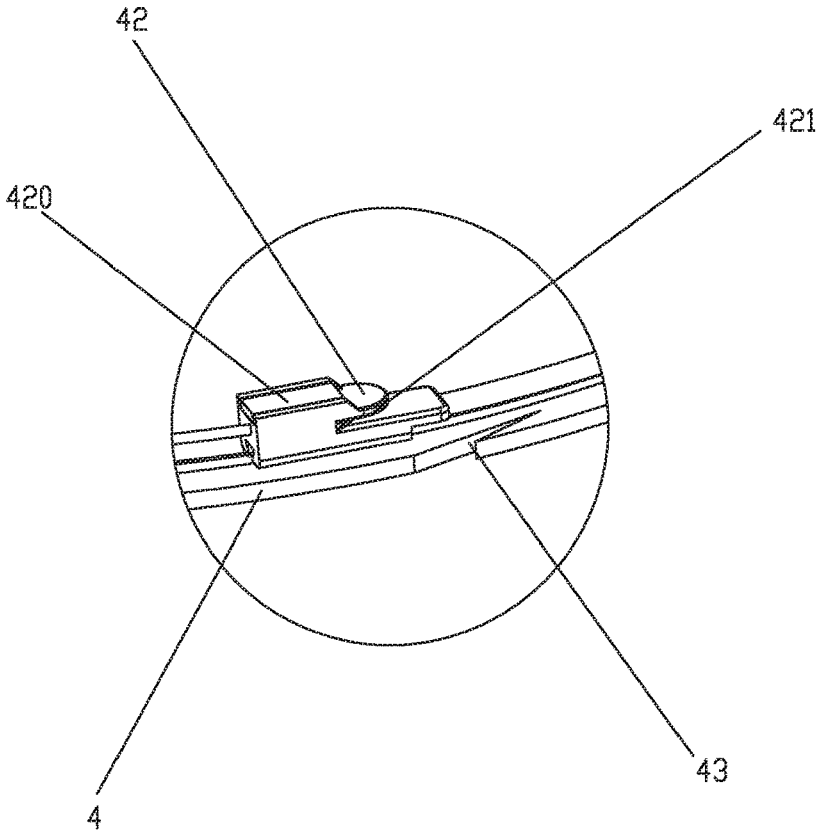
FIG. 10 is an enlarged view of part A of FIG. 9.
Figure 11:
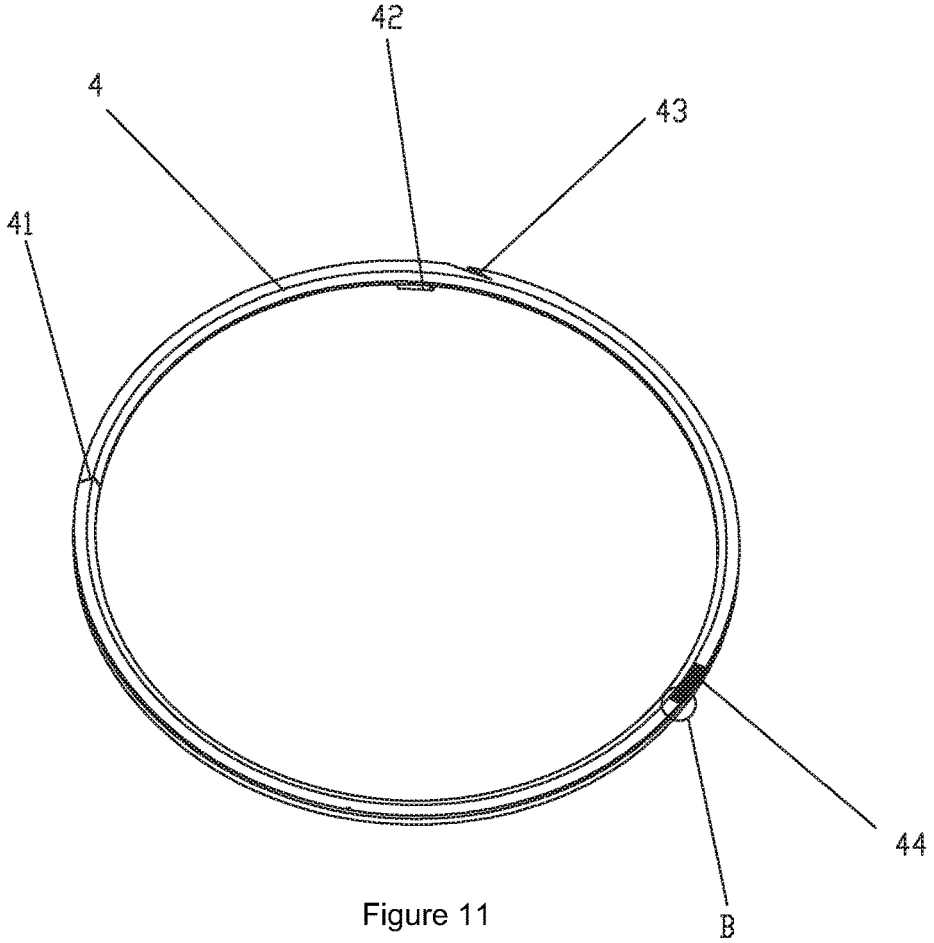
FIG. 11 is another perspective view of the shuttle of the invention.
Figure 12:
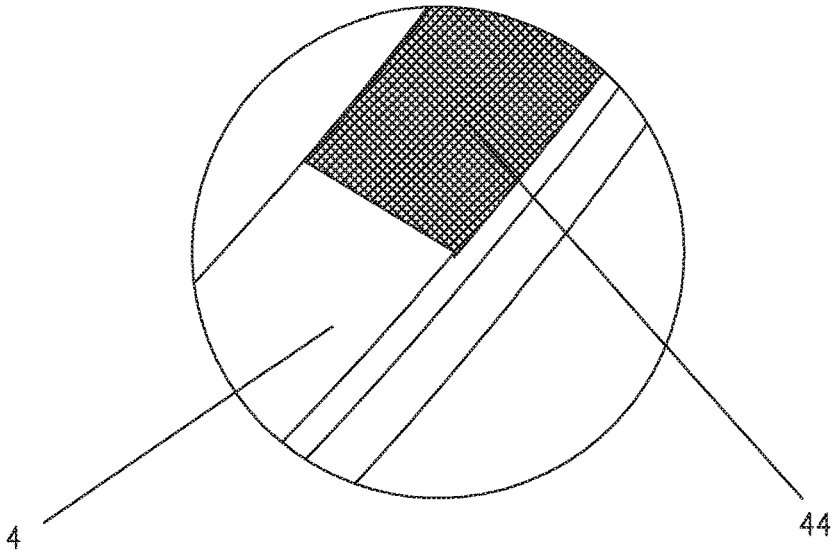
FIG. 12 is an enlarged view of part B of FIG. 11.

The present invention will be further described below in detail in combination with the accompanying drawings.

As illustrated in the FIG. 1 to FIG. 17, an automatic toroidal core winding machine includes:

a frame 1 configured for installing of various mechanisms thereon;

a control device 2 disposed on the frame 1 and configured to control operation of each mechanism/device;

a clamping and wire arranging mechanism 3 disposed on the frame 1 and configured to clamp and rotate a toroidal core to be winded with a wire;

a winding mechanism, comprising a shuttle 4 having a ring opening 41 and a driving device 5 for supporting and driving the shuttle 4 to rotate, the shuttle 4 is provided with a slider 42 and a wire storage and hooking aperture 43, and the frame 1 is provided with a wire hanging device 6 for hanging the wire allowing the shuttle 4 to store the wire and to wind the wire respectively;

a detecting and positioning mechanism 7 disposed around the shuttle 4 and used for positioning the ring opening 41, the slider 42 and the wire storage and hooking aperture 43 of the shuttle 4;

a wire delivering mechanism 8 disposed at one side of the frame 1 and configured to deliver a wire to the shuttle 4, a wire cutting device 80 which connected to the wire hanging device 6 is equipped with the free end of the wire;

a feeding mechanism 9 comprising a vibratory feeder bowl 91 disposed on the frame 1, a feeding chute 92 docking with the vibratory feeder bowl 91, and a toroidal core delivering manipulator 93 for clamping and delivering a toroidal core to the clamping and wire arranging mechanism 3; and an automatic stripping mechanism 10 disposed on the frame 1 and configured to take out a wound toroidal core.

The clamping and wire arranging mechanism 3 in the present invention includes a support 31, two rubber wheel holders 32 capable of sliding separately and disposed oppositely on the support 31, the opposite ends of the two rubber wheel holders 32 are respectively provide with a clamping rubber wheel pair 33, the other ends of the two rubber wheel holders 32 are elastically connected to a jacking cylinder 34 and the support 31, respectively, and a driving assembly 30 for driving the clamping rubber wheel pair 33 to rotate is disposed on the support 31. The elastic connection may be specifically provided as follows: a spring 35, a spring pushing part 36 and a spring cover plate 37 are disposed on each rubber wheel holder 32 in sequence from inside to outside; the opposite clamping rubber wheel pairs 33 clamp a toroidal core, the telescopic end of the jacking cylinder 34 extends through the elastic cover plate 37 to be connected with the spring pushing part 36, and a supporting rod 38 extending through the spring cover plate 37 to be connected with the spring pushing part 36 is disposed on the support 31. Certainly, the elastic connection may also be connection by a leaf spring.

The driving device 5 in the present invention includes a driving guide wheel set 51 and two driven guide wheels 52 which all arranged on the frame 1, the driving guide wheel set 51 is driven by a driving motor 54 to rotate and has three driving guide wheels, each of the driven guide wheels 52 is connected with an open-loop assembly 53 capable of driving the driven guide wheel 52 to move radially to enable the shuttle to be opened and closed in parallel along the ring opening 41. Parallel ring opening means that in the ring opening process, the shuttle 4 is maintained within a same plane, thereby avoiding influence on the service life thereof due to dislocation. Parallel ring opening may be achieved through expanding from the inner periphery of the shuttle 4 by the driven guide wheel 52 the driven guide wheels 52 or by other mechanism, for example, pulling apart the shuttle 4 outwardly from the outer periphery thereof at the same.

Preferably, the open-loop assembly 53 includes a base 531 disposed on the frame 1, a sliding rail 532 disposed on the base 531, and a power slider 533 is disposed on the sliding rail 532, which is capable of sliding back and forth thereon, an open-loop driver 534 for driving the power slider 533 to slide is disposed on the base 531, and transmission between the power slider 533 and the open-loop driver 534 is achieved by means of a belt assembly, and the power slider 533 is provided with a supporting part 535 extending into the shuttle 4 and supporting the corresponding driven guide wheel 52. The two driven guide wheels 52 are opposite in direction of motion during ring opening.

More preferably, during ring opening, the ring opening 41 is located between the two driven guide wheels 52, and a plurality of driving guide wheels of the driving guide wheel set 51 are uniformly distributed between the two driven guide wheels 52 along the inner periphery of the shuttle 4 and opposite to the ring opening 41. Ring opening within a plane is achieved by fully utilizing the guide wheels for the shuttle 4, thereby avoiding loss of dislocated ring opening and also saving design space of structure.

The wire hanging device 6 in the present invention includes a pushing assembly 61 capable of clamping a wire and pushing it to the wire storage and hooking aperture 43, and a fixing bracket 62, both are arranged on the frame 1, the pushing assembly 61 includes a pushing cylinder 611 arranged on the frame 1 and a wire clamping manipulator 612 connected to the telescopic end of the pushing cylinder 611, the fixing bracket 62 is provided with a wire lifting cylinder 63 capable of driving the wire cutting device 80 to move in an axial direction of the shuttle 4 to enable the wire to cling to the edge of the shuttle 4 or the edge of the slider 42, a wire hooking cylinder 64 capable of driving the wire cutting device 80 to move in a direction perpendicular to the axial direction of the shuttle 4 is arranged on the fixing bracket 62, and the wire hooking cylinder 64 is connected to the telescopic end of the wire lifting cylinder 63. A wire tensioning cylinder 65 for tensioning the wire when the toroidal core is in the process of winding is arranged on the fixing bracket 62, and the wire tensioning cylinder 65 is disposed between the fixing bracket 62 and the wire lifting cylinder 63, the wire lifting cylinder 63 is connected to the telescopic end of the wire tensioning cylinder 65 and the wire tensioning cylinder 65 is configured to further tension the copper wire after hooking the wire, thereby facilitating tight wire winding around the toroidal core. Pushing, lifting, hanging and tensioning of the wire are all achieved by moving the wire cutting device 80, and the wire is cut off after being in place.

The detecting and positioning mechanism 7 in the present invention includes a shuttle positioning assembly 71 and a slider positioning assembly 72, the shuttle positioning assembly 71 includes a color spot 44 disposed on the shuttle 4, a reflective optical fiber 711 for sensing the color spot 44 and transmitting a signal to control the shuttle 4 to stop rotating is disposed on the frame 1, the slider positioning assembly 72 includes a proximity sensor 721 for sensing the slider 42, and a wire hanging positioner 722 and an open-loop positioner 723 both for blocking the slider 42 from rotating along with the shuttle 4. The wire hanging positioner 722 and the open-loop positioner 723 are both cylinders disposed on the frame 1 around the shuttle 4. The wire hanging positioner 722 and the open-loop positioner 723 are staggered from each other and both staggered from the ring opening 41.

Preferably, the slide 42 is integrally-moulded by plastic, a metal sheet 420 is disposed on the slider 42 as a target for the proximity sensor 721 to sense. Thus, the sensing range can be reduced, allowing faster and more accurate detecting and positioning movements.

Figure 13:
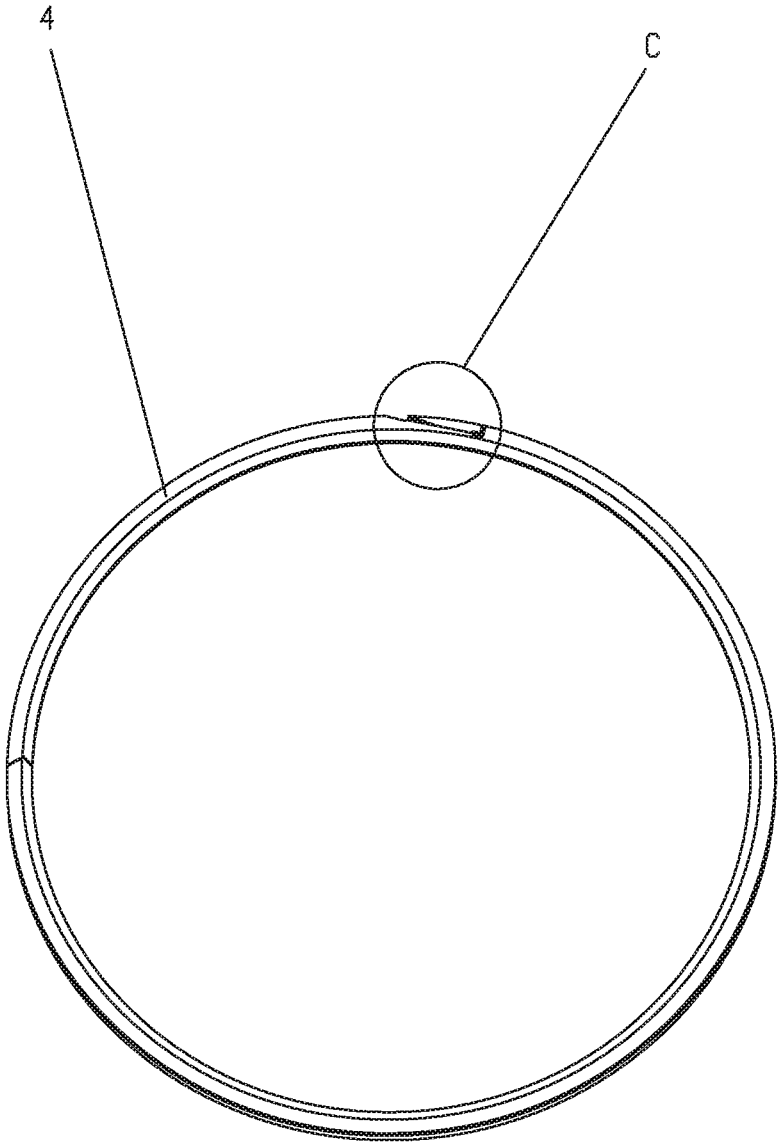
FIG. 13 is a perspective view of the shuttle according another embodiment of the invention.
Figure 14:
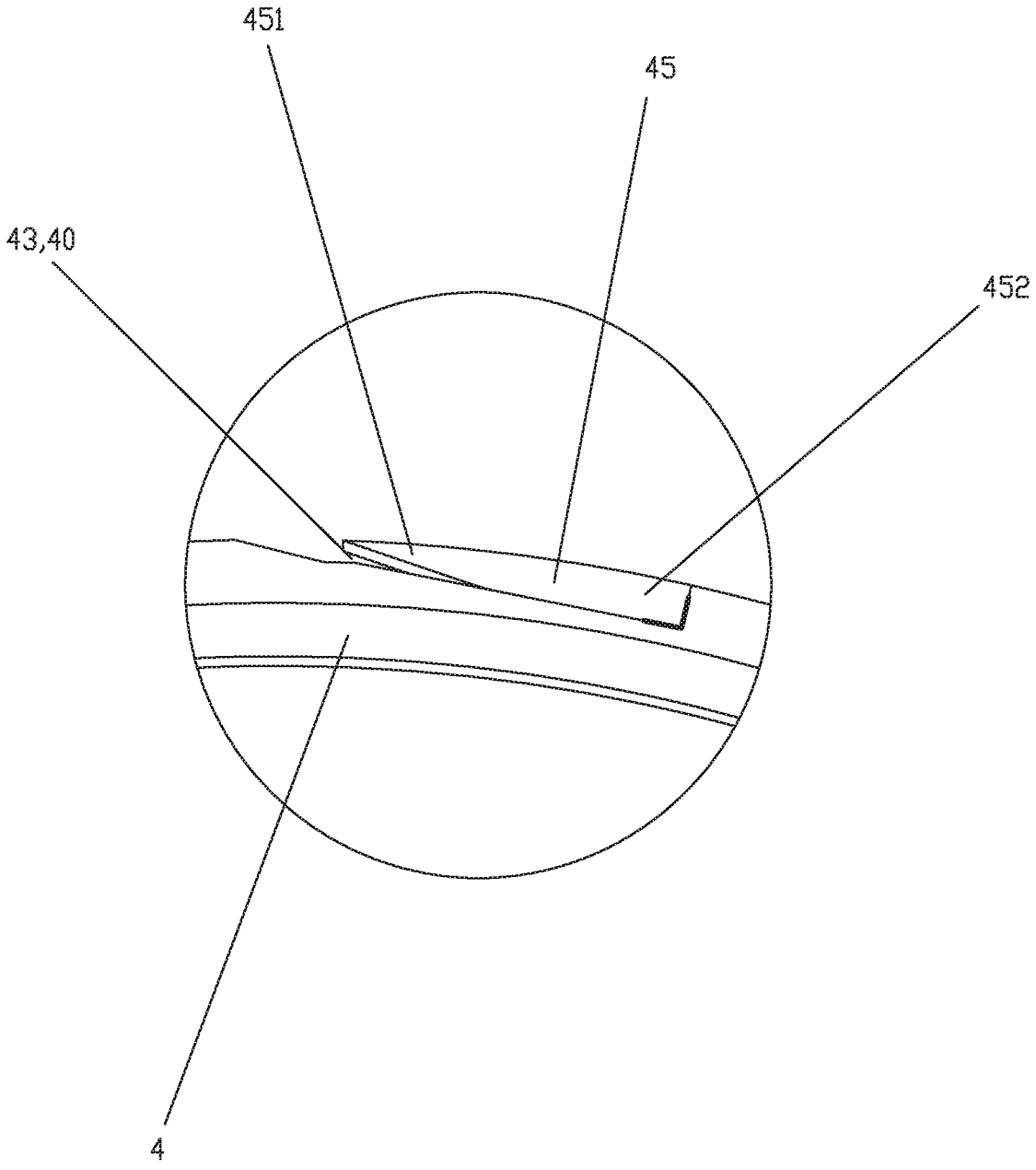
FIG. 14 is an enlarged view of part C of FIG. 13.
Figure 15:
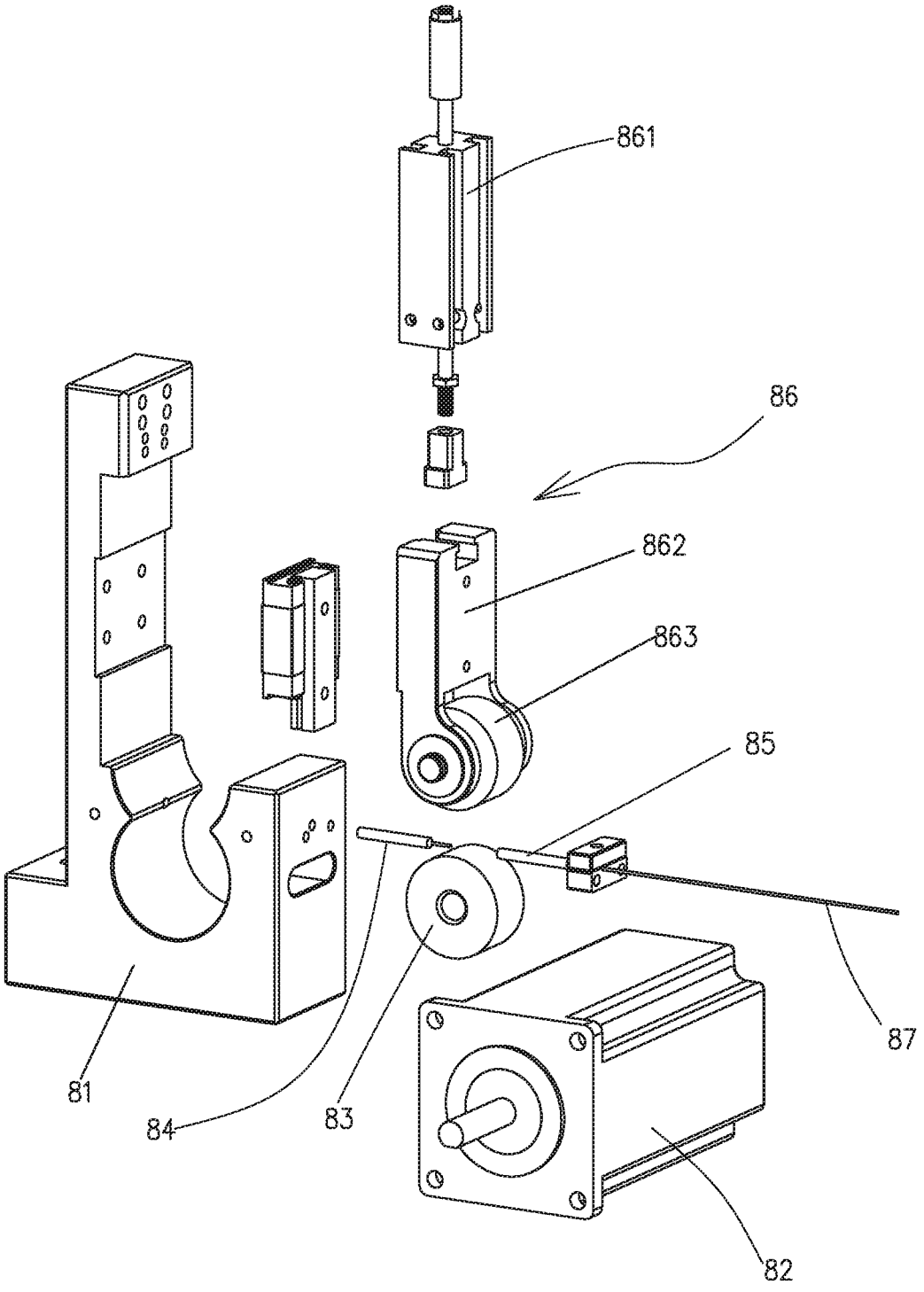
FIG. 15 is an exploded view of the wire delivering mechanism of the invention.
Figure 16:
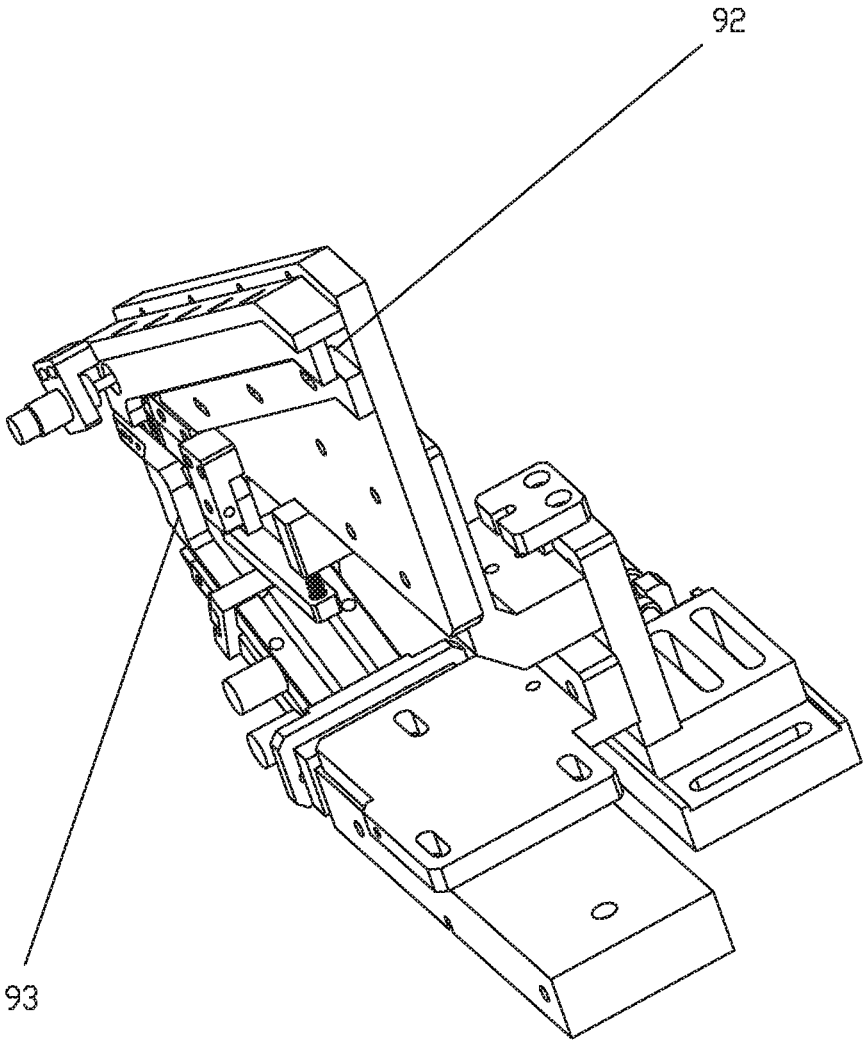
FIG. 16 is a partial view of the feeding mechanism of the invention.

Now turning to FIG. 13 and FIG. 14, another embodiment of the shuttle 4 in the present invention is illustrated. A notch 40 is formed increasingly deep in the shuttle 4 from the outer periphery to the inner periphery, the tail of the notch 40 is right-angled, and an elastic steel part 45 with a tail against the tail of the notch 40 is welded at the notch 40, the wire storage and hooking aperture 43 is an included angle formed by the elastic steel part 45 and the notch 40 that gradually decreases to 0 degree from the outer periphery of the shuttle inwardly. So even a wire having a minimum diameter can be hooked automatically.

Further, the wire hooking inlet end 451 of the elastic steel part 45 is a pointed end, and the side, against the notch 40, of a wire hooking chucking end 452 of the elastic steel part 45 is a flat face, the pointed end 451 of the elastic steel part 45 is transitional to the wire hooking chucking end 452 with a cambered surface.

The detecting and positioning mechanism 7 cooperates with the wire hanging device 6 to achieve automatic ring opening and wire hooking of the winding machine.

The wire delivering mechanism 8 in the present invention includes a pedestal 81, a rubber wheel 83 driven by a motor 82 to rotate is disposed on the pedestal 81, a detachable wire-in nozzle 84 and a detachable wire-out nozzle 85 run through the pedestal 81, and the pedestal 81 is provided with a wire hold-down assembly 86 capable of extending out and matching the rubber wheel 83 to deliver a copper wire.

Preferably, the wire hold-down assembly 86 includes a wire hold-down cylinder 861 disposed on the pedestal 81, a movable seat 862 is connected to the telescopic end of the wire hold-down cylinder 861, and a hold-down wheel 863 opposite to the rubber wheel 83 is disposed at the free end of the movable seat 862.

Preferably, the wire-out nozzle 85 is externally connected to a capillary steel tube 87 so as to better deliver a wire, meanwhile, this facilitates later maintenance, and only the wire-in nozzle 84 or the wire-out nozzle 85 needs to be replaced.

At least two sidewalls of the feeding chute 92 in the present invention may be installed adjustably in position to allow changing of the inner diameter of the feeding chute 92, the side walls are in threaded connection in pairs by means of an elongated slotted hole, thereby facilitating adjusting the inner diameter of the feeding chute 92, preferably, the three sidewalls are adjustable in installation position. As a result, better universality of the feeding mechanism 9 can be achieved.

The automatic stripping mechanism 10 may includes a belt type module 101 disposed on the frame 1, and one end of the belt type module 101 is provided with a stripping motor 102 connected with the belt type module 101 by means of a coupler 103. A stripping cylinder 104 is disposed on the belt type module 101 so as to drive the stripping cylinder 104 to move, and the telescopic end of the stripping cylinder 104 is connected with a gripper 105 capable of opening and closing to grip and release a toroidal coil. Thus, automatic stripping of the toroidal core after winding is achieved.

Figure 17:
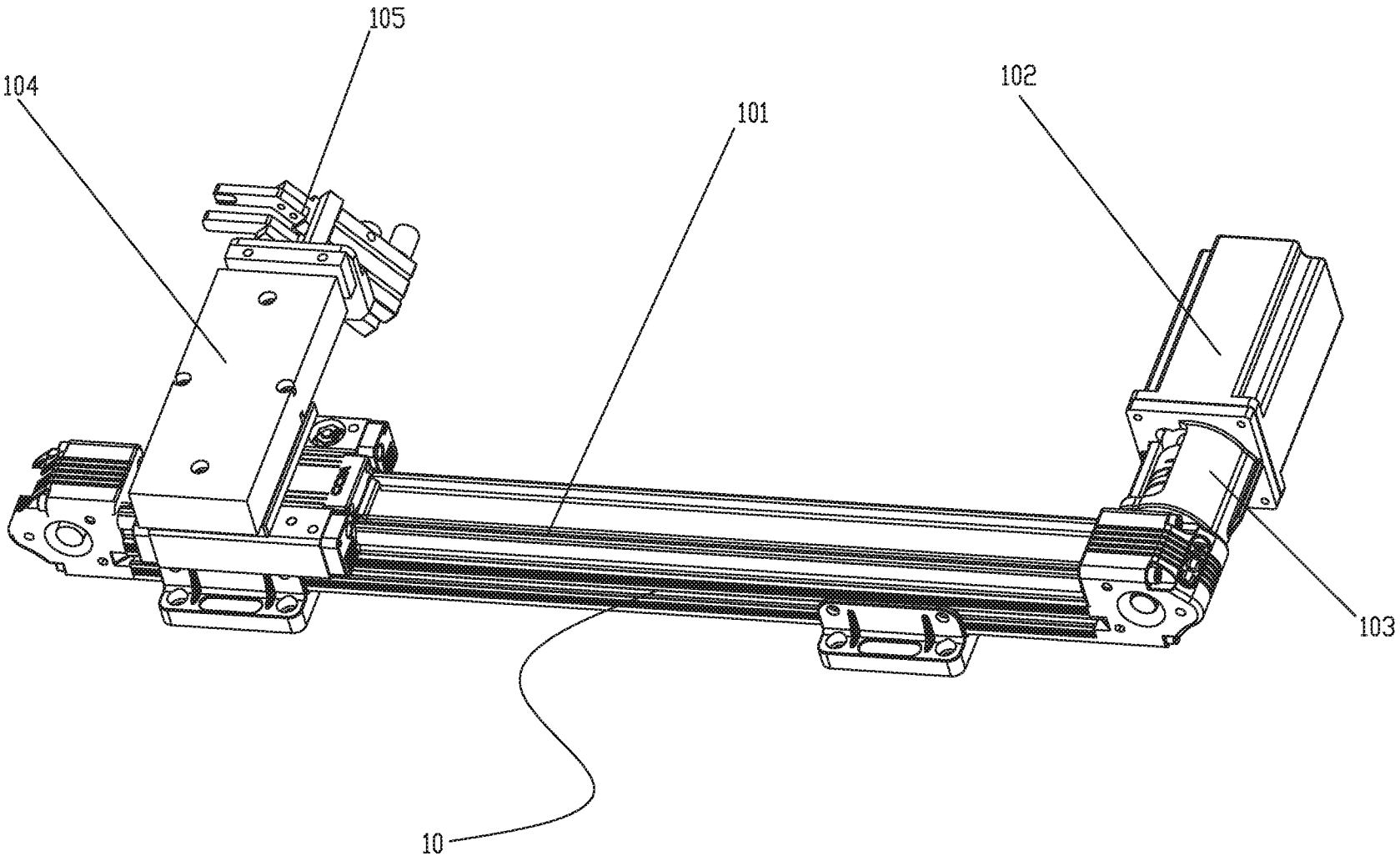
FIG. 17 is a perspective view of an embodiment of the automatic stripping mechanism of the invention.
Figure 18:
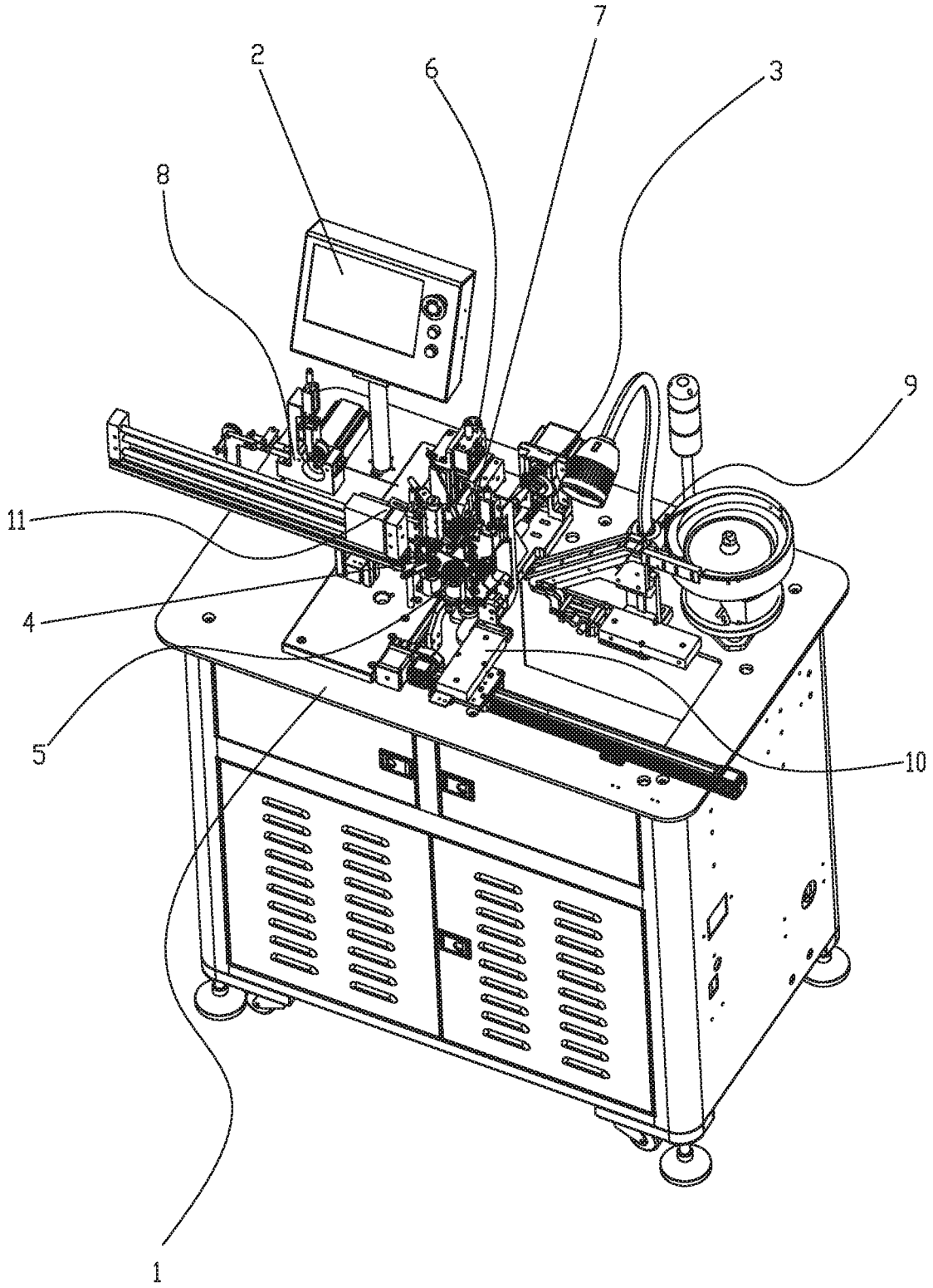
FIG. 18 is a perspective view of another embodiment of the invention.
Figure 19:
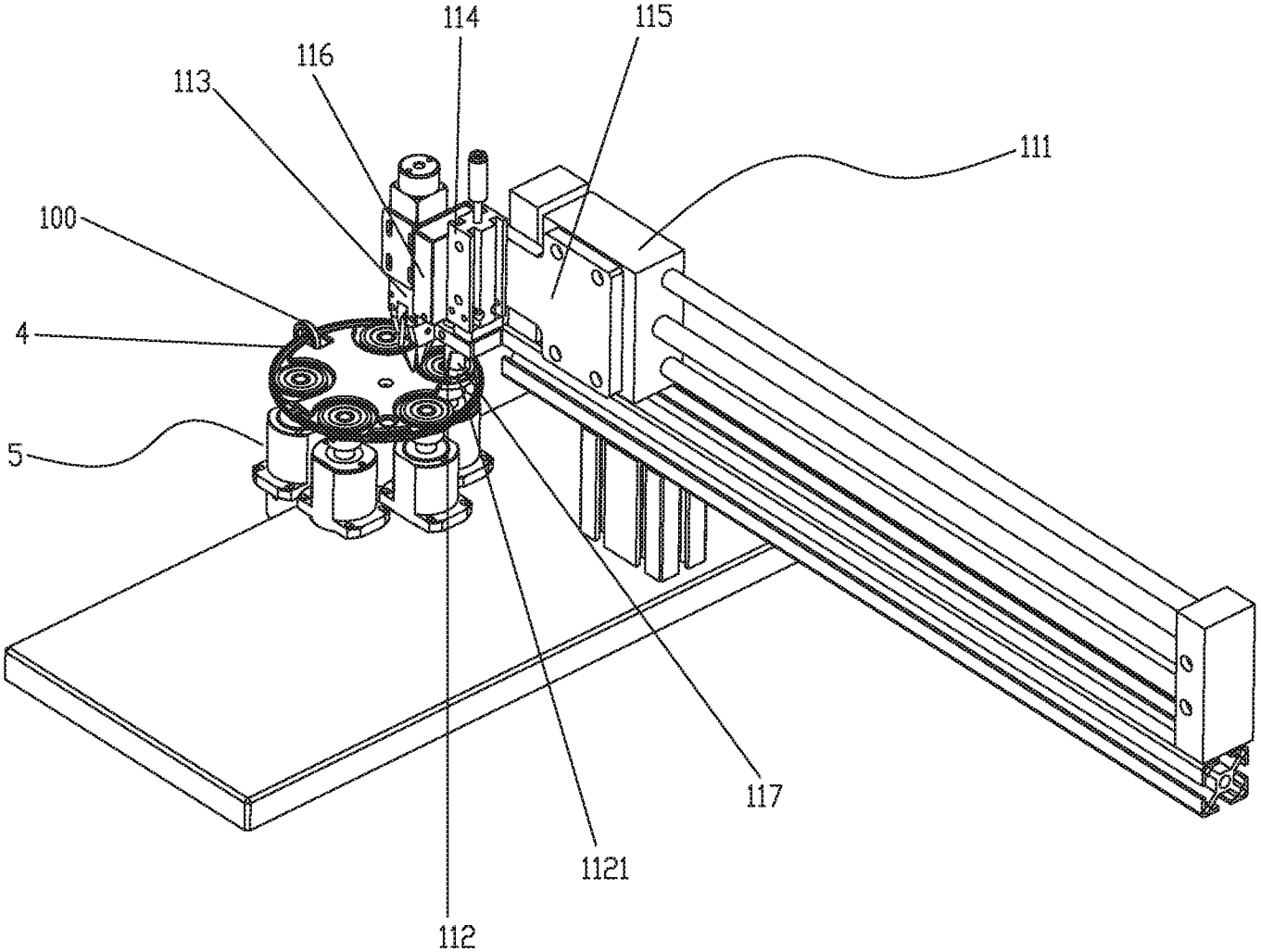
FIG. 19 is a perspective view of the wire reclaiming device of the invention in an applied configuration.
Figure 20:
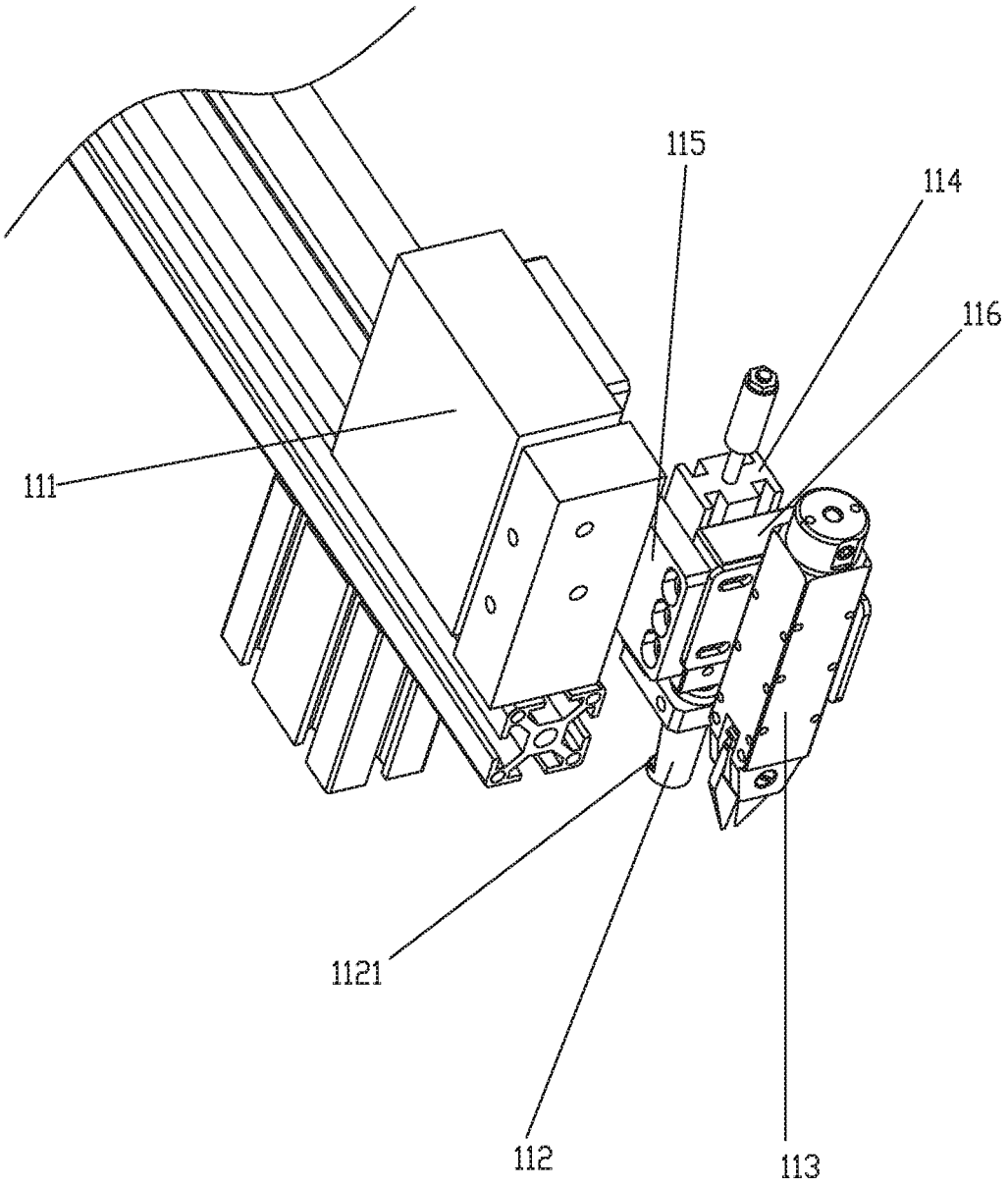
FIG. 20 is the first perspective view of the wire reclaiming device of the invention.
Figure 22:
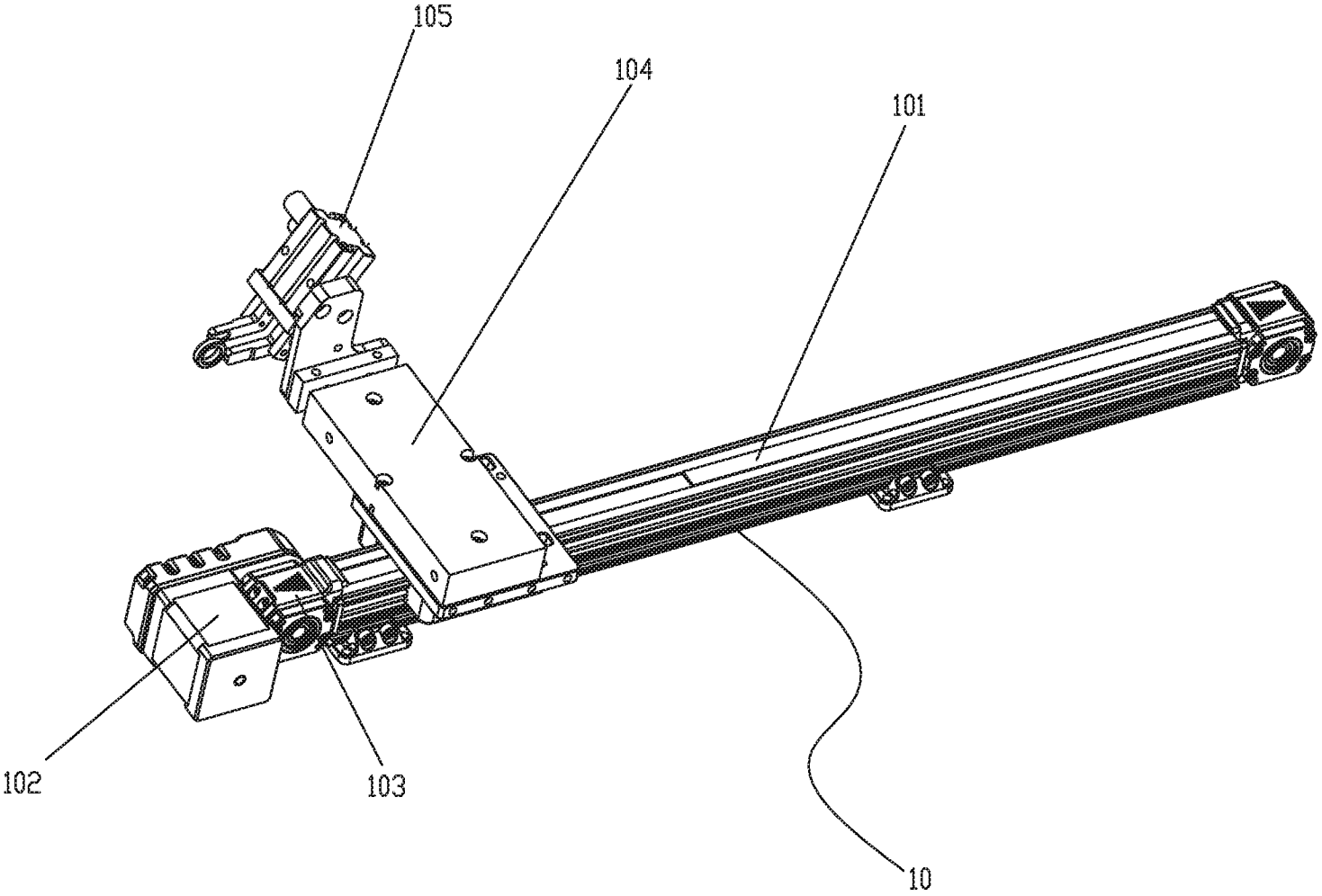
FIG. 22 is a perspective view of another embodiment of the automatic stripping mechanism of the invention.

Another embodiment of the automatic stripping mechanism 10 in the present invention is the automatic stripping mechanism shown in FIG. 18 and is also illustrated in FIG. 22, wherein the installation direction of the stripping motor 102 is opposite to that in FIG. 17 and the installation direction of the gripper 105 is also opposite to that in FIG. 17. The specific installation position of the automatic stripping mechanism 10 is not limited as long as the objective of automatically gripping a toroidal coil can be achieved.

Figure 21:
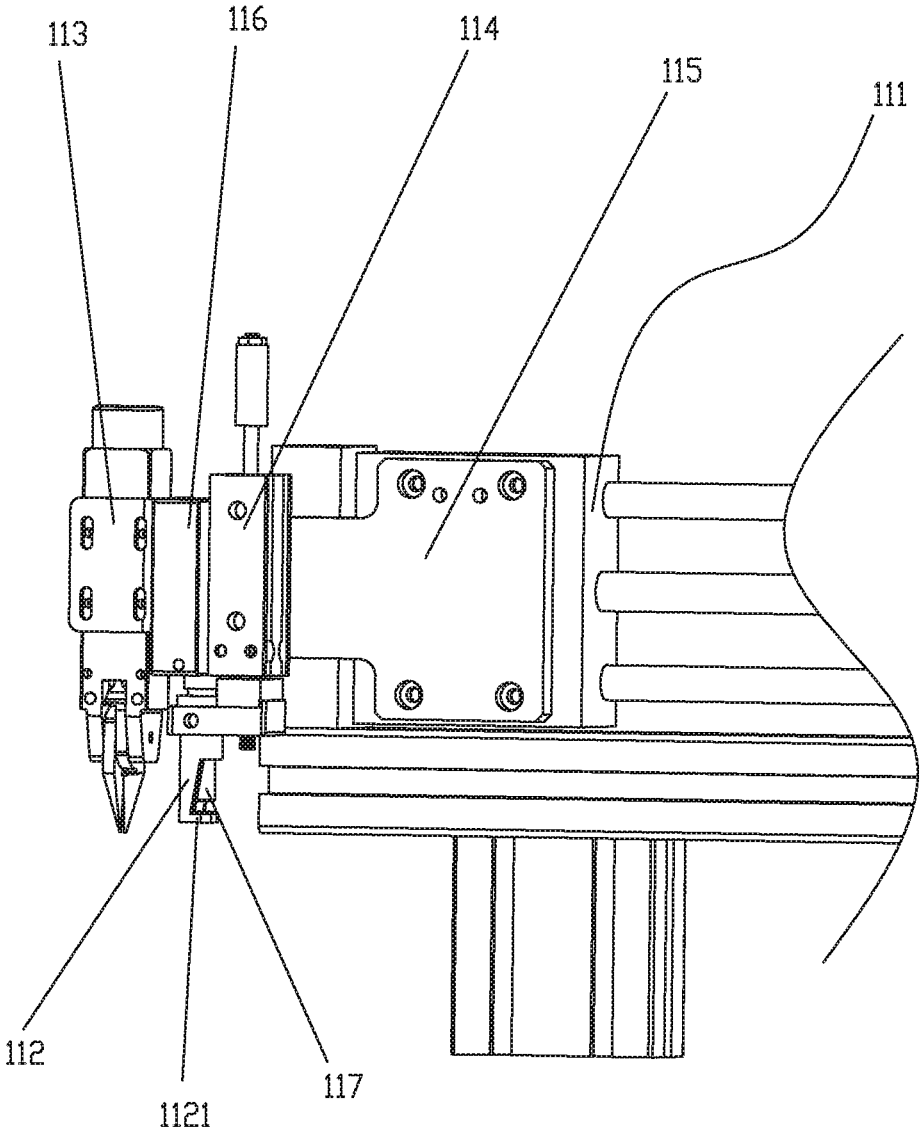
FIG. 21 is the second perspective view of the wire reclaiming device of the invention.

In a preferred embodiment as illustrated in FIG. 18 and FIG. 21, a wire reclaiming device 11 for reclaiming excessive wires on the shuttle 4 may also be disposed on the frame 1 in the present invention, the wire reclaiming device 11 may includes a pushing-pulling mechanism 111 disposed on a platen of the frame 1 and capable of sliding away from or close to the shuttle 4. A wire hooking rod 112 capable of moving perpendicularly to the shuttle 4 is disposed at the end, close to the shuttle, of the pushing-pulling mechanism 111. A pair of pneumatic scissors 113 is disposed between the wire hooking rod 112 and the toroidal core 100 on the shuttle 4, and the open end of the pneumatic scissors 113 is higher than the surface of the shuttle 4. The wire hooking rod 112 is driven by a telescoping cylinder 114 disposed on the pushing-pulling mechanism 111 to descend into or ascend away from the shuttle 4.

Preferably, a connecting plate 115 is disposed on the movable part of the pushing-pulling mechanism 111, and a fixed block 116 is disposed on the connecting plate 115. The telescoping cylinder 114 and the pneumatic scissors 113 are disposed at two sides of the fixed block 116, respectively.

Further, a wire hold-down rod 117 is disposed on the fixed block 116, the wire hooking rod 112 sleeves the wire hold-down rod 117, a wire hooking plate 1121 opposite to the end of the wire hold-down rod 117 is disposed at the free end of the wire hooking rod 112. Thus, a wire may not drop down when winded around the wire hooking rod 112. After winding is completed, the wire hooking rod 112 ascends to hold down the winded wire between the wire hooking plate 1121 and the wire hold-down rod 117. After the wire is cut off, wires do not scatter and are easy to be reclaimed.

Preferably, when the wire hooking rod 112 hooking a wire (reclaiming the excessive wire), the wire hooking rod 112 is located within the peripheral inner space of the shuttle 4 and faces the toroidal coil 100 on the shuttle 4. Specifically, when the wire hooking rod 112 extends into the shuttle 4, the wire hooking rod 112 faces the toroidal coil 100 along the periphery of the shuttle 4, allowing winding the wire around the toroidal coil 100 and the wire hooking rod 112 at a maximum distance.

Further, the pushing-pulling mechanism 111 is a double-rod cylinder, and the cylinder is the movable part of the pushing-pulling mechanism 111. Certainly, the pushing-pulling mechanism 111 may also be a belt conveying assembly or other structure capable of a reciprocating motion.

Further, the wire hooking rod 112 and the wire hooking plate 1121 are integrally formed to prevent wire jamming. The wire hooking rod 112 is tubular with a trapezoidal hole formed in the peripheral surface of the lower end thereof such that the wire hooking plate 1121 and the peripheral surface of the wire hooking rod 112 are in the form of inverted number 7, thereby facilitating wire hooking and preventing slipping.

During production of the present invention, the detecting and positioning mechanism 7 detects the rotating shuttle 4 and positions the slider 42 and the ring opening 41 thereon, the open-loop assembly 53 acts to cause the ring opening 41 of the shuttle 4 to be opened in a plane direction, the feeding mechanism 9 feeds a toroidal core between the hold-down rubber wheels of the clamping and wire arranging mechanism 3, and the shuttle 4 is closed across the toroidal core. Next, the wire delivering mechanism 8 delivers a wire through the wire cutting device 80, allowing the wire to point to the shuttle 4, the pushing assembly 61 of the wire hanging device 6 delivers the wire to the edge of the wire storage and hooking aperture 43, the wire lifting cylinder 63 acts to make the wire against the inner wall of the wire storage and hooking aperture 43, and the shuttle 4 is rotated to tightly hook the wire, then, the shuttle 4 revolves to store the wire. When the wire storage is completed, the detecting and positioning mechanism 7 positions the slider 42, and the wire lifting cylinder 63 acts to make the wire in the shuttle against the edge of a wire hooking aperture 421 of the slider 42, while the wire hooking cylinder 64 acts to push forward to hook the wire against the edge of the wire hooking aperture 421 into the wire hooking aperture 421 of the slider 42, thus, the wire hooking movements are completed. Subsequently, wire winding is started, after the wire winding is completed, the wire tensioning cylinder 65 further lifts to tension the wire around the toroidal core, then, the detecting and positioning mechanism 7 positions the ring opening 41 of the shuttle 4 again, the open-loop assembly 53 opens the ring opening 41 of the shuttle 4 within one plane, and the stripping mechanism 10 acts to take out the winded toroidal core. Continuous winding can be achieved by repeating the movements after the feeding of a toroidal core.

The present invention achieves whole-course automatic winding from wire delivery, shuttle opening and final stripping, and the invention is of great progress for toroidal core winding with significantly saved human cost and improved production efficiency and production quality. As a result, real automatic production is achieved.

Concerning the wire reclaiming device during the process of winding, the pushing-pulling mechanism 111 acts to push the wire hooking rod 112 and the pneumatic scissors 113 to over the shuttle 4, when a set number of turns of the wire around the toroidal core 100 is reached, the telescopic cylinder 114 acts to push down to drive the wire hooking rod 112 fixed thereon to push down beneath the shuttle 4, and winding is continued to wind the excessive wire around the toroidal core 100 and the wire hooking rod 112. When all the stored wire is winded completely, the telescopic cylinder 114 acts to retract, thereby driving the wire hooking rod 112 to lift the copper wire winded around the toroidal core 100 and the wire hooking rod 112, the wire hooking rod 112 is lifted to the wire hooking plate 1121 press against the wire hold-down rod 117 such that the wire is held down between the wire hold-down rod 117 and the wire hooking plate 1121 so as to be fixed. Then, the pneumatic scissors 113 act to automatically cut off the wire winded between the toroidal core 100 and the wire hooking rod 112. The pushing-pulling mechanism 111, i.e., the double-rod cylinder, acts to carry the wires fixed between the wire hold-down rod 117 and the wire hooking rod 112 to a specified storage position. Finally, the telescopic cylinder 114 acts to push the wire hooking rod 112 down such that the excessive wires fall into a storage box.

The invention claimed is:

1. An automatic toroidal core winding machine, comprising:

a frame, configured for installing of various mechanisms and devices thereon, the various mechanisms and devices comprising:

a control device, disposed on the frame and configured to control the automatic toroidal core winding machine;

a clamping and wire arranging mechanism, disposed on the frame and configured to clamp and rotate a toroidal core to be winded with a wire;

a winding mechanism, comprising a shuttle having a ring opening and a driving device for supporting and driving the shuttle to rotate, the shuttle is provided with a slider and a wire storage and hooking aperture, and the frame is provided with a wire hanging device for hanging the wire allowing the shuttle to store the wire and to wind the wire;

a detecting and positioning mechanism, disposed around the shuttle and used for positioning the ring opening, the slider and the wire storage and hooking aperture of the shuttle;

a wire delivering mechanism, disposed at one side of the frame and configured to deliver a wire to the shuttle, a wire cutting device which connected to the wire hanging device is equipped with the free end of the wire;

a feeding mechanism, comprising a vibratory feeder bowl disposed on the frame, a feeding chute docking with the vibratory feeder bowl, and a toroidal core delivering manipulator for clamping and delivering a toroidal core to the clamping and wire arranging mechanism; and an automatic stripping mechanism, disposed on the frame and configured to take out a winded toroidal core, wherein the driving device includes a driving guide wheel set and two driven guide wheels which all arranged on the frame, the driving guide wheel set is driven by a driving motor to rotate, each of the driven guide wheels is connected with an open-loop assembly capable of driving the driven guide wheel to move to enable the shuttle to be opened and closed in parallel along the ring opening, and the open-loop assembly includes a base disposed on the frame, a sliding rail is disposed on the base, and a power slider is disposed on the sliding rail, which is capable of sliding back and forth thereon, an open-loop driver for driving the power slider to slide is disposed on the base, and the power slider is provided with a supporting part extending into the shuttle and supporting the driven guide wheel.

2. The automatic toroidal core winding machine according to claim 1, wherein the clamping and wire arranging mechanism includes a support, two rubber wheel holders capable of sliding separately and disposed oppositely on the support, the opposite ends of the two rubber wheel holders are respectively provide with a clamping rubber wheel pair, the other ends of the two rubber wheel holders are elastically connected to a jacking cylinder and the support respectively, and a driving assembly for driving the clamping rubber wheel pairs to rotate is disposed on the support.

3. The automatic toroidal core winding machine according to claim 1, wherein the wire hanging device includes a pushing assembly capable of clamping a wire tight and pushing it to the wire storage and hooking aperture, and a fixing bracket, both are arranged on the frame, the fixing bracket is provided with a wire lifting cylinder capable of driving the wire cutting device to move in an axial direction of the shuttle to enable the wire to cling to the edge of the shuttle or the edge of the slider, a wire hooking cylinder capable of driving the wire cutting device to move in a direction perpendicular to the axial direction of the shuttle, and a wire tensioning cylinder for tensioning the wire when the toroidal core is in the process of winding are arranged on the fixing bracket, the pushing assembly includes a pushing cylinder arranged on the frame and a wire clamping manipulator connected to the telescopic end of the pushing cylinder.

4. The automatic toroidal core winding machine according to claim 1, wherein the detecting and positioning mechanism includes a shuttle positioning assembly and a slider positioning assembly, the shuttle positioning assembly includes a color spot disposed on the shuttle, and a reflective optical fiber for sensing the color spot and transmitting a signal to control the shuttle to stop rotating is disposed on the frame, and the slider positioning assembly includes a proximity sensor for sensing the slider, a wire hanging positioner, and an open-loop positioner, wherein the wire hanging positioner and the open-loop positioner are both for blocking the slider from rotating along with the shuttle.

5. The automatic toroidal core winding machine according to claim 4, wherein the slider is integrally-moulded by plastic, and a metal sheet is arranged on the slider as a sensed target.

6. The automatic toroidal core winding machine according to claim 1, wherein the slider is integrally-moulded by plastic, and a metal sheet is arranged on the slider as a sensed target.

7. The automatic toroidal core winding machine according to claim 1, wherein a notch is formed increasingly deep in the shuttle from the outer periphery to the inner periphery, the tail of the notch is right-angled, and an elastic steel part whose tail against the tail of the notch is welded at the notch, the wire storage and hooking aperture is an included angle formed by the elastic steel part and the notch that gradually decreases to 0 degree from the outer periphery of the shuttle inwardly.

8. The automatic toroidal core winding machine according to claim 1, wherein the wire delivering mechanism includes a pedestal, a rubber wheel driven by a motor to rotate is disposed on the pedestal, a detachable wire-in nozzle and a detachable wire-out nozzle run through the pedestal, and the pedestal is provided with a wire hold-down assembly capable of extending out and matching the rubber wheel to deliver a copper wire.

9. The automatic toroidal core winding machine according to claim 1, wherein at least two sidewalls of the feeding chute are installed adjustably in position to allow changing of the inner diameter of the feeding chute.

10. The automatic toroidal core winding machine according to claim 1, wherein a wire reclaiming device for reclaiming excessive wires around the shuttle is disposed on the frame, the wire reclaiming device includes a pushing-pulling mechanism disposed on a platen of the frame which is capable of sliding away from or close to the shuttle, a wire hooking rod capable of moving perpendicularly to the shuttle is disposed at the end, close to the shuttle, of the pushing-pulling mechanism, and a pair of pneumatic scissors is disposed between the wire hooking rod and the toroidal core on the shuttle, the open end of the pneumatic scissors is higher than the surface of the shuttle.

11. The automatic toroidal core winding machine according to claim 10, wherein the wire hooking rod is driven by a telescoping cylinder disposed on the pushing-pulling mechanism to descend into or ascend away from the shuttle.

12. The automatic toroidal core winding machine according to claim 11, wherein a connecting plate is disposed on the movable part of the pushing-pulling mechanism, and a fixed block is disposed on the connecting plate, the telescoping cylinder and the pneumatic scissors are disposed at two sides of the fixed block, respectively.

13. The automatic toroidal core winding machine according to claim 12, wherein a wire hold-down rod is disposed on the fixed block, the wire hooking rod sleeves the wire hold-down rod, a wire hooking plate opposite to the end of the wire hold-down rod is disposed at the free end of the wire hooking rod.

14. The automatic toroidal core winding machine according to claim 10, wherein when hooking a wire, the wire hooking rod is located within the peripheral inner space of the shuttle and faces the toroidal coil on the shuttle.

15. An automatic toroidal core winding machine, comprising:

a frame, configured for installing of various mechanisms; and devices thereon, the various mechanisms and devices comprising:

a control device, disposed on the frame and configured to control the automatic toroidal core winding machine;

a clamping and wire arranging mechanism, disposed on the frame and configured to clamp and rotate a toroidal core to be winded with a wire;

a winding mechanism, comprising a shuttle having a ring opening and a driving device for supporting and driving the shuttle to rotate, the shuttle is provided with a slider and a wire storage and hooking aperture, and the frame is provided with a wire hanging device for hanging the wire allowing the shuttle to store the wire and to wind the wire;

a detecting and positioning mechanism, disposed around the shuttle and used for positioning the ring opening, the slider and the wire storage and hooking aperture of the shuttle;

a wire delivering mechanism, disposed at one side of the frame and configured to deliver a wire to the shuttle, a wire cutting device which connected to the wire hanging device is equipped with the free end of the wire;

a feeding mechanism, comprising a vibratory feeder bowl disposed on the frame, a feeding chute docking with the vibratory feeder bowl, and a toroidal core delivering manipulator for clamping and delivering a toroidal core to the clamping and wire arranging mechanism;

an automatic stripping mechanism, disposed on the frame and configured to take out a winded toroidal core; and a wire reclaiming device for reclaiming excessive wires around the shuttle is disposed on the frame, wherein the wire reclaiming device includes a pushing-pulling mechanism disposed on a platen of the frame which is capable of sliding away from or close to the shuttle, a wire hooking rod capable of moving perpendicularly to the shuttle is disposed at the end, close to the shuttle, of the pushing-pulling mechanism, and a pair of pneumatic scissors is disposed between the wire hooking rod and the toroidal core on the shuttle, the open end of the pneumatic scissors is higher than the surface of the shuttle.

16. The automatic toroidal core winding machine according to claim 15, wherein the wire hooking rod is driven by a telescoping cylinder disposed on the pushing-pulling mechanism to descend into or ascend away from the shuttle.

17. The automatic toroidal core winding machine according to claim 16, wherein a connecting plate is disposed on the movable part of the pushing-pulling mechanism, and a fixed block is disposed on the connecting plate, the telescoping cylinder and the pneumatic scissors are disposed at two sides of the fixed block, respectively.

18. The automatic toroidal core winding machine according to claim 17, wherein a wire hold-down rod is disposed on the fixed block, the wire hooking rod sleeves the wire hold-down rod, a wire hooking plate opposite to the end of the wire hold-down rod is disposed at the free end of the wire hooking rod.

19. The automatic toroidal core winding machine according to claim 15, wherein when hooking a wire, the wire hooking rod is located within the peripheral inner space of the shuttle and faces the toroidal coil on the shuttle.

20. An automatic toroidal core winding machine, comprising:

a frame, configured for installing of various mechanisms; and devices thereon, the various mechanisms and devices comprising:

a control device, disposed on the frame and configured to control the automatic toroidal core winding machine;

a clamping and wire arranging mechanism, disposed on the frame and configured to clamp and rotate a toroidal core to be winded with a wire;

a winding mechanism, comprising a shuttle having a ring opening and a driving device for supporting and driving the shuttle to rotate, wherein the shuttle is provided with a slider integrally-moulded by plastic and a metal sheet is arranged on the slider as a sensed target, and a wire storage and hooking aperture, and the frame is provided with a wire hanging device for hanging the wire allowing the shuttle to store the wire and to wind the wire;

a detecting and positioning mechanism, disposed around the shuttle and used for positioning the ring opening, the slider and the wire storage and hooking aperture of the shuttle;

a wire delivering mechanism, disposed at one side of the frame and configured to deliver a wire to the shuttle, a wire cutting device which connected to the wire hanging device is equipped with the free end of the wire;

a feeding mechanism, comprising a vibratory feeder bowl disposed on the frame, a feeding chute docking with the vibratory feeder bowl, and a toroidal core delivering manipulator for clamping and delivering a toroidal core to the clamping and wire arranging mechanism; and an automatic stripping mechanism, disposed on the frame and configured to take out a winded toroidal core.

* * * * *